US012234118B2

(12) United States Patent
Dutton et al.

(10) Patent No.: US 12,234,118 B2
(45) **Date of Patent: *Feb. 25, 2025**

(54) REEL TRANSPORT, STAND AND PAYOFF DEVICE

(71) Applicant: ESA Fabrication, LLC, Phoenix, AZ (US)

(72) Inventors: Virgil Ray Dutton, Fort McDowell, AZ (US); Bradley C. Phillips, Scottsdale, AZ (US); Michael Buller, Chandler, AZ (US)

(73) Assignee: ESA Fabrication, LLC, Phoenix, AZ (US)

( * ) Notice: Subject to any disclaimer, the term of this patent is extended or adjusted under 35 U.S.C. 154(b) by 286 days.

This patent is subject to a terminal disclaimer.

(21) Appl. No.: 17/825,388

(22) Filed: May 26, 2022

(65) Prior Publication Data

US 2022/0281712 A1 Sep. 8, 2022

Related U.S. Application Data

(60) Continuation-in-part of application No. 17/087,018, filed on Nov. 2, 2020, now Pat. No. 11,591,181, which is a division of application No. 16/167,997, filed on Oct. 23, 2018, now Pat. No. 10,934,129.

(60) Provisional application No. 62/575,760, filed on Oct. 23, 2017.

(51) Int. Cl.
*B65H 75/40* (2006.01)
*B65H 75/44* (2006.01)

(52) U.S. Cl.
CPC ..... *B65H 75/403* (2013.01); *B65H 75/4465* (2013.01); *B65H 2406/40* (2013.01)

(58) Field of Classification Search
CPC .... B65H 75/40; B65H 75/403; B65H 75/441; B65H 75/4465; B65H 2406/40; B65H 49/321
See application file for complete search history.

(56) References Cited

U.S. PATENT DOCUMENTS

| | | | | |
|---|---|---|---|---|
| 2,452,481 | A | 10/1948 | Morehead et al. | |
| 3,944,094 | A * | 3/1976 | Compton | B62B 3/10 414/458 |
| 4,447,012 | A | 5/1984 | Woodruff | |
| 4,711,407 | A | 12/1987 | Boon | |
| 10,934,129 | B1 * | 3/2021 | Harmon | B65H 75/403 |
| 11,591,181 | B2 * | 2/2023 | Harmon | B65H 49/38 |
| 2017/0144685 | A1 | 5/2017 | McVay | |

(Continued)

*Primary Examiner* — Sang K Kim
(74) *Attorney, Agent, or Firm* — Schmeiser, Olsen & Watts LLP; Sean K. Enos

(57) ABSTRACT

A reel transport, stand and payoff device is provided, which operates to maneuver and jack up a reel for payoff. The reel device may include two reel mechanisms coupled together with a hydraulic system housing. Each reel mechanism includes a wheel housing and a wheel coupled to a central portion of the wheel housing. Each reel mechanism includes an arm coupled on an end to a central portion of the wheel housing. An actuator is coupled between the wheel housing and the arm to raise or lower the arm. The reel device may include at least one caster to help support and stabilize the reel device. An axle is inserted through a reel and coupled on each end to an arm by a bracket. A method of use of a reel transport, stand and payoff device is also disclosed.

8 Claims, 23 Drawing Sheets

(56) References Cited

U.S. PATENT DOCUMENTS

| | | | |
|---|---|---|---|
| 2018/0155158 | A1 | 6/2018 | LeVey |
| 2018/0170706 | A1 | 6/2018 | Grabowski et al. |

* cited by examiner

REEL TRANSPORT, STAND AND PAYOFF DEVICE

CROSS REFERENCE TO RELATED APPLICATION[S]

This application is a continuation-in-part application of U.S. Nonprovisional patent application entitled "REEL TRANSPORT, STAND AND PAYOFF DEVICE," Ser. No. 17/087,018, filed Nov. 2, 2020, which is a division of U.S. Nonprovisional patent application entitled "REEL TRANSPORT, STAND AND PAYOFF DEVICE," Ser. No. 16/167,997, filed Oct. 23, 2018, which claims priority to the earlier U.S. Provisional Patent application entitled "REEL TRANSPORT, STAND AND PAYOFF DEVICE," Ser. No. 65/575,760, filed Oct. 23, 2017, the disclosures of which are hereby incorporated entirely herein by reference.

BACKGROUND OF THE INVENTION

Technical Field

This invention relates generally to stand and payoff systems for cable or wire reels and more particularly to a reel transport, stand and payoff device that operates to maneuver and lift up a reel for payoff.

State of the Art

Conventionally, reels of cable or wire are utilized on construction worksites and other uses. Typically, a hand truck, fork lift or other transport device is used to transport or maneuver a reel around a location. It is then loaded onto a stand or other payoff system in order for payoff or unwinding of the cable or wire. This is time consuming and requires additional manpower to get the reel into a position for use. These systems are lacking in efficiency for transport, storage, and payoff of the reel of cable or wire. Further, conventional systems lack take-up functionality that allows for spool-up/loading of a spool or reel with wire or cable from another reel.

SUMMARY OF THE INVENTION

The present invention relates to a reel transport, stand and payoff device that operates to maneuver and jack up a reel for payoff or take-up. The device may be used for any material stored in such a way that allows it to be wound or unwound on a reel.

An embodiment includes a reel device comprising: two reel mechanisms, each reel mechanism comprising: a wheel housing; a wheel coupled to a central portion of the wheel housing; an arm coupled on an end to a central portion of the wheel housing; and an actuator operably coupled between the wheel housing and the arm, whereby extension of the actuator rotates the arm to a lifted position and retraction of the actuator rotates the arm to a lowered position; a hydraulic system housing coupled between the two reel mechanisms, wherein the hydraulic housing retains a hydraulic system for operating the actuators; a caster coupled to a center portion of the hydraulic housing; an arm assembly coupled between the two wheel housings; a brake system biased to a brake engaged position and moveable to a brake released position for transport of the reel device; and an axle coupled between an end of each arm of the reel mechanisms, the axle configured to receive a reel thereon.

Another embodiment includes a method of use of a reel device is also disclosed, comprising the steps of extending an axle of the reel device through an axle sleeve of the reel; coupling the axle between arms of reel mechanisms of the reel device; moving the arms from a lowered position to a lifted position, wherein the lifted position lifts the reel off of a ground surface; transporting the reel by use of wheels of the reel device; and maintaining the arms in the lifted position for reel payoff.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
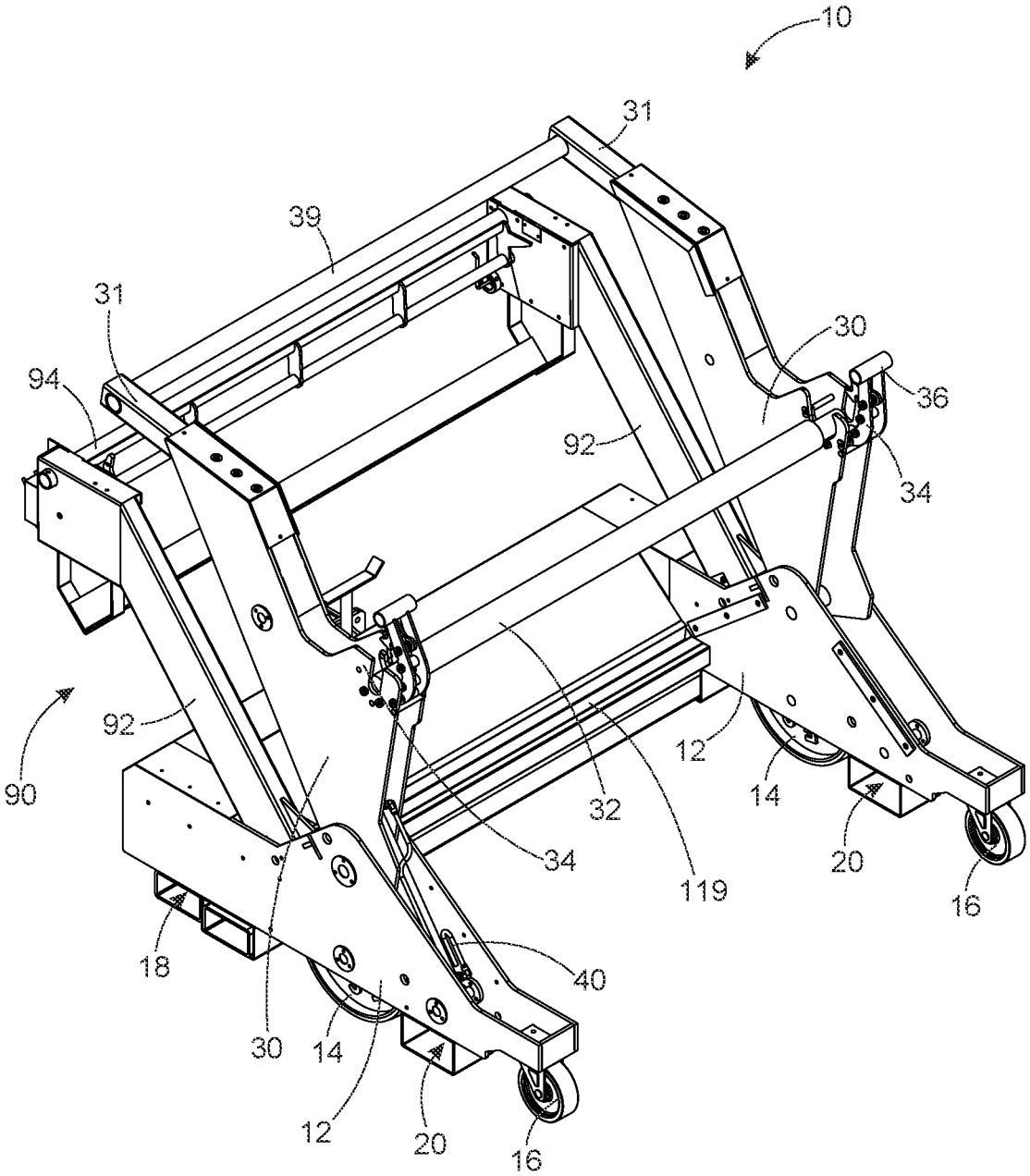
FIG. 1 is a perspective view of a reel device in a lifted position in accordance with an embodiment.

As discussed above, embodiments of the present invention relate to a reel transport, stand and payoff device that operates to maneuver and jack up a reel for payoff or take-up.

Referring to the drawings, FIGS. 1-8 depict an embodiment of a reel transport, stand and payoff device 10, referred to as a reel device 10. The reel device 10 includes two reel mechanisms 11. Each reel mechanism 11 includes a wheel housing 12 and a wheel 14 coupled to the wheel housing. In embodiments, the wheel housing may include two plates with a wheel 14 operably coupled between the plates. The reel device 10 further includes a first caster 16 for steering and support for transport and loading a reel onto the reel device 10.

Figure 2A:
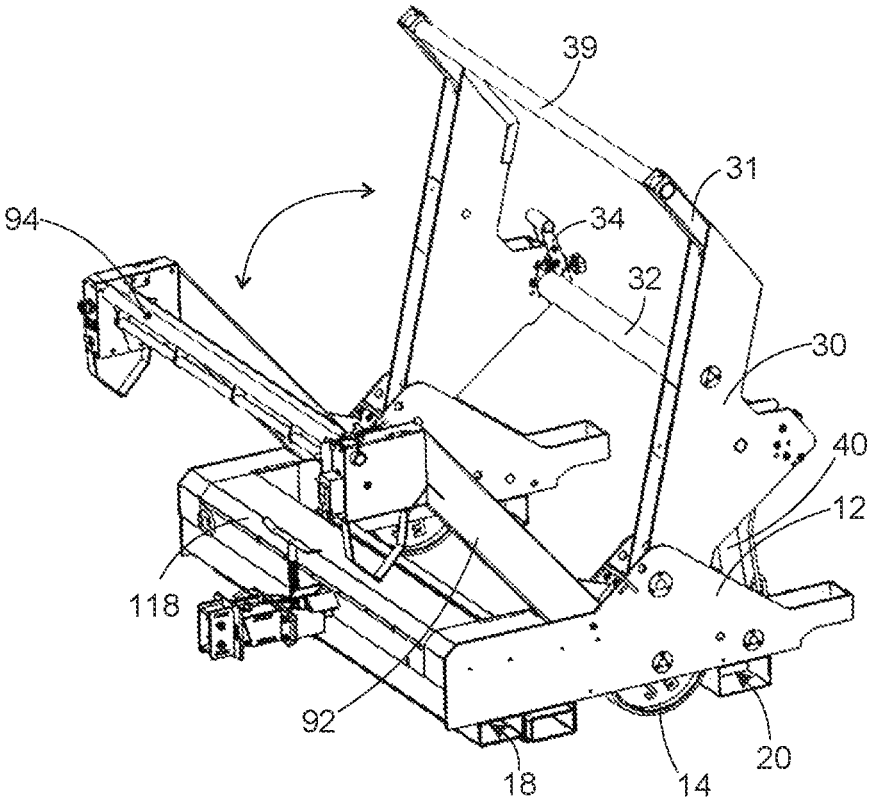
FIG. 2A is a perspective view of a reel device in a lowered position in accordance with an embodiment.
Figure 2B:
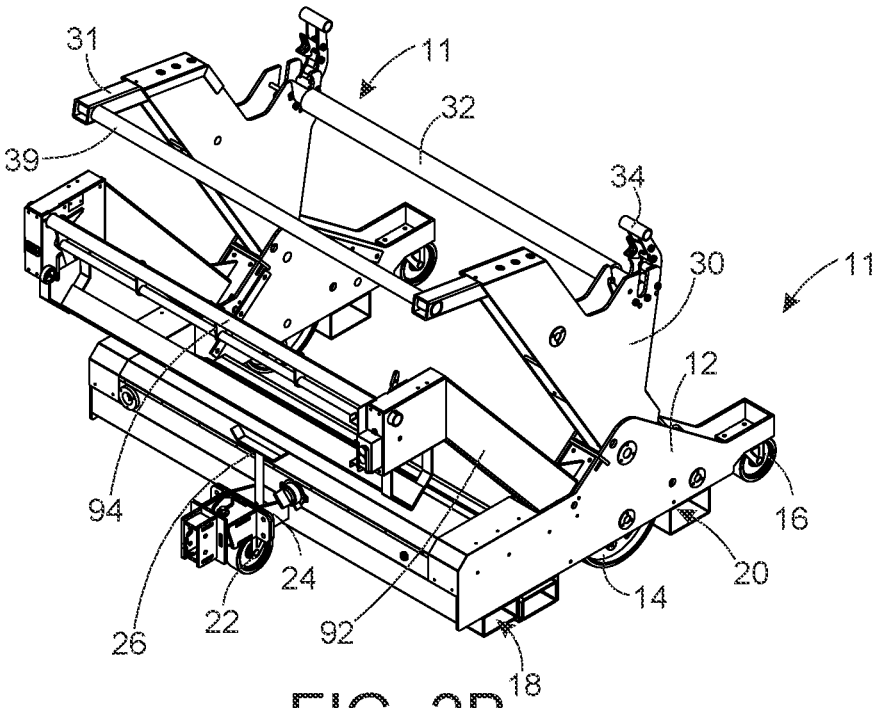
FIG. 2B is a perspective view of a reel device in a lifted position in accordance with an embodiment.
Figure 3A:
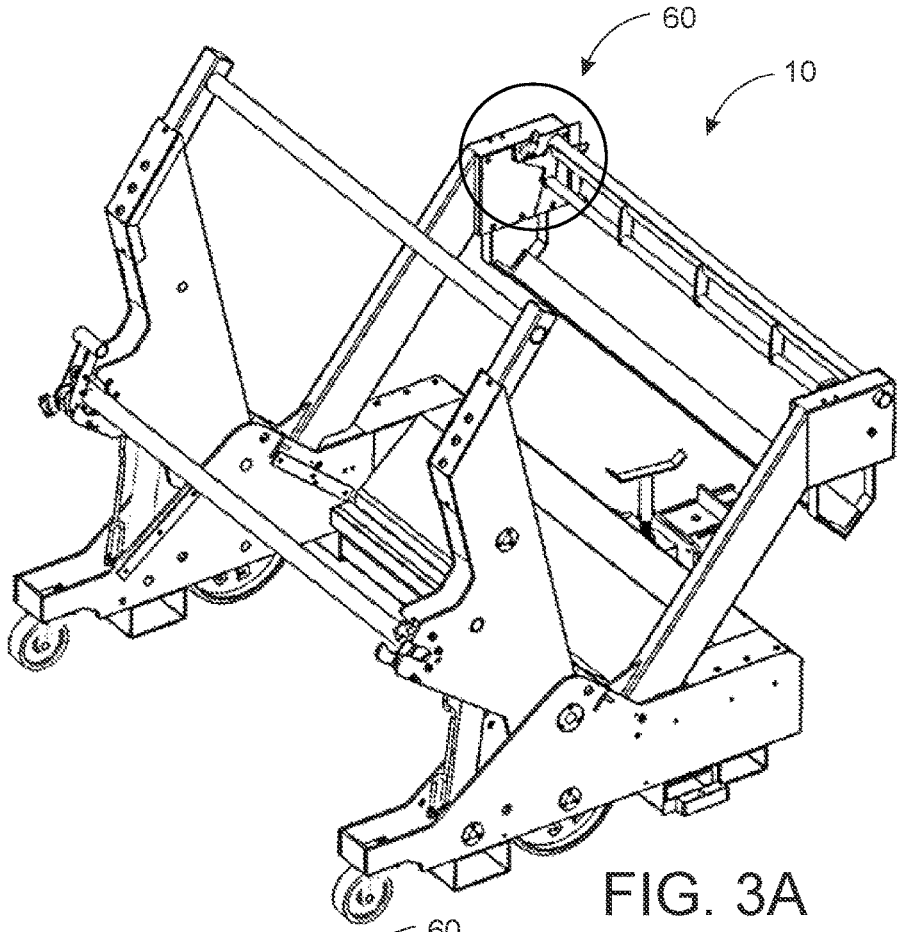
FIG. 3A is perspective view of a brake system of a reel device in accordance with an embodiment.
Figure 3B:
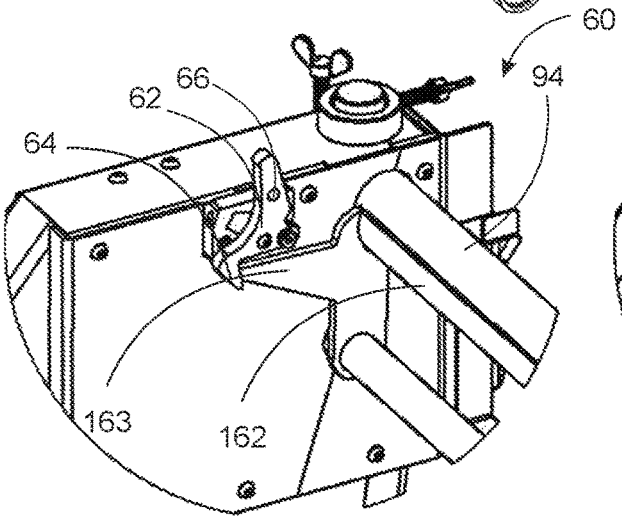
FIG. 3B is perspective view of a brake defeat in position to hold a brake system of a reel device in a brake release position in accordance with an embodiment.
Figure 3C:
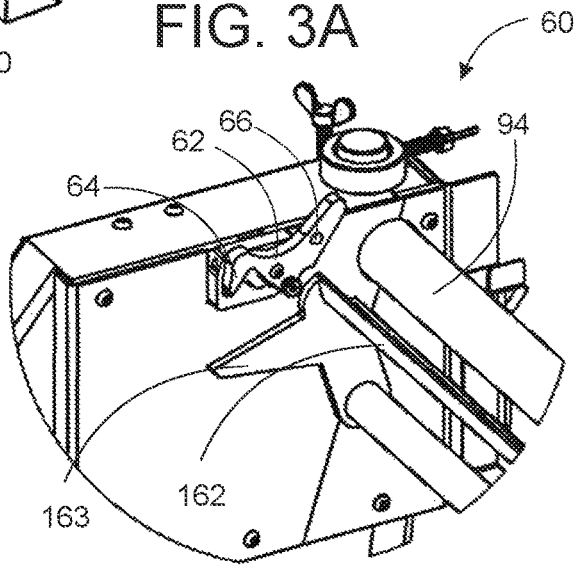
FIG. 3C is perspective view of a brake defeat in position to allow a brake system of a reel device to be in a brake engaged position in accordance with an embodiment.
Figure 3D:
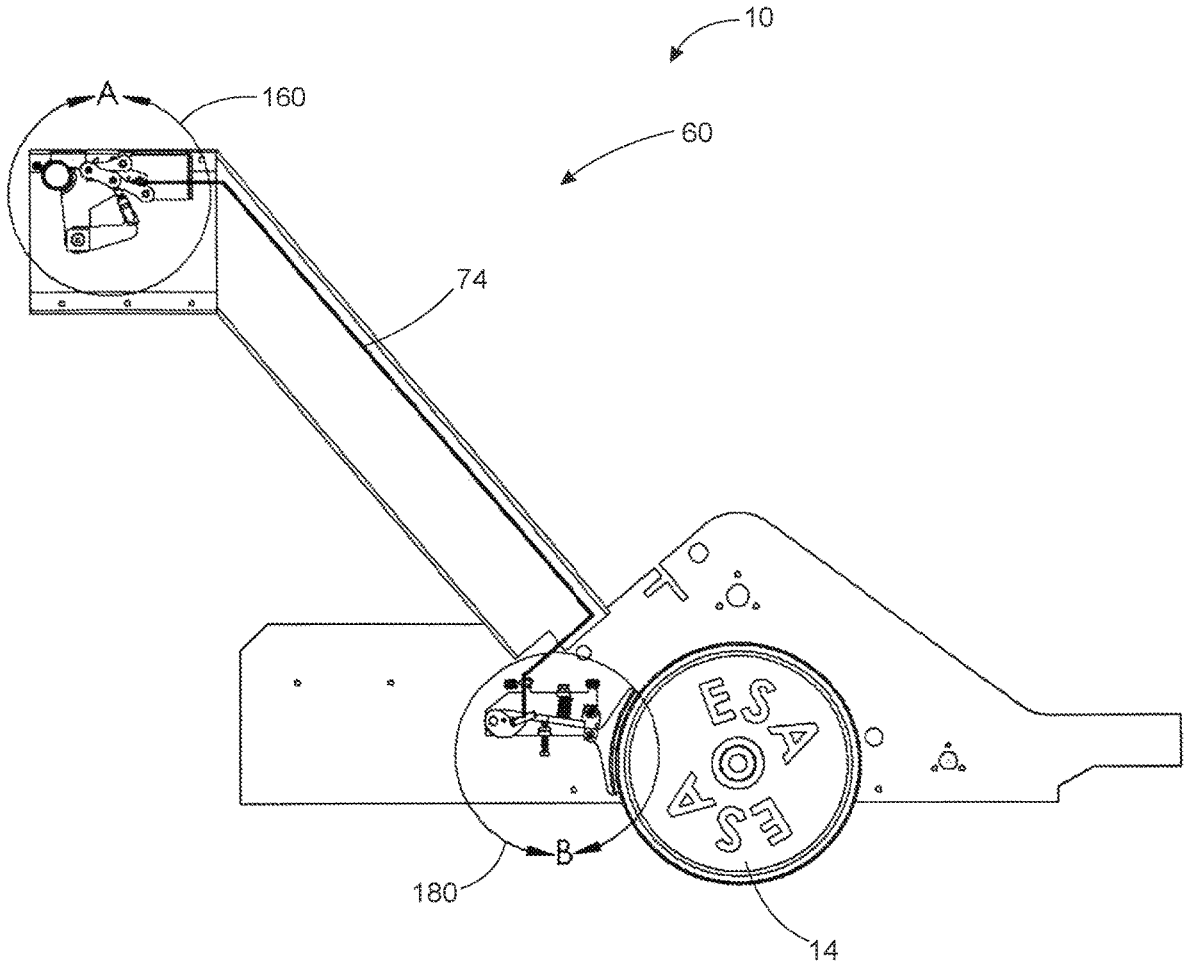
FIG. 3D is side view of a brake system of a reel device in accordance with an embodiment.
Figure 3E:
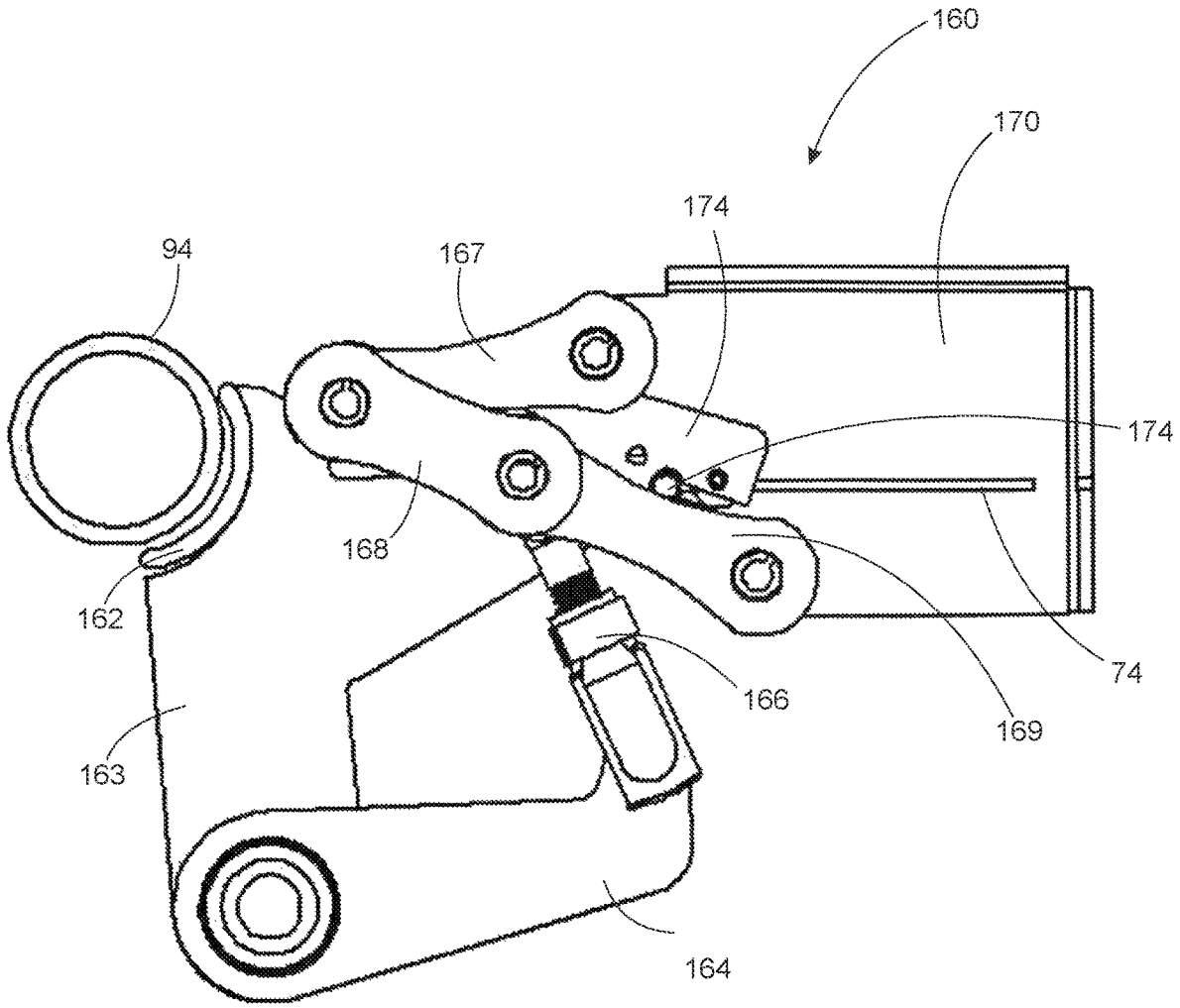
FIG. 3E is side view of a brake handle mechanism of a brake system of a reel device in a brake released position in accordance with an embodiment.
Figure 3F:
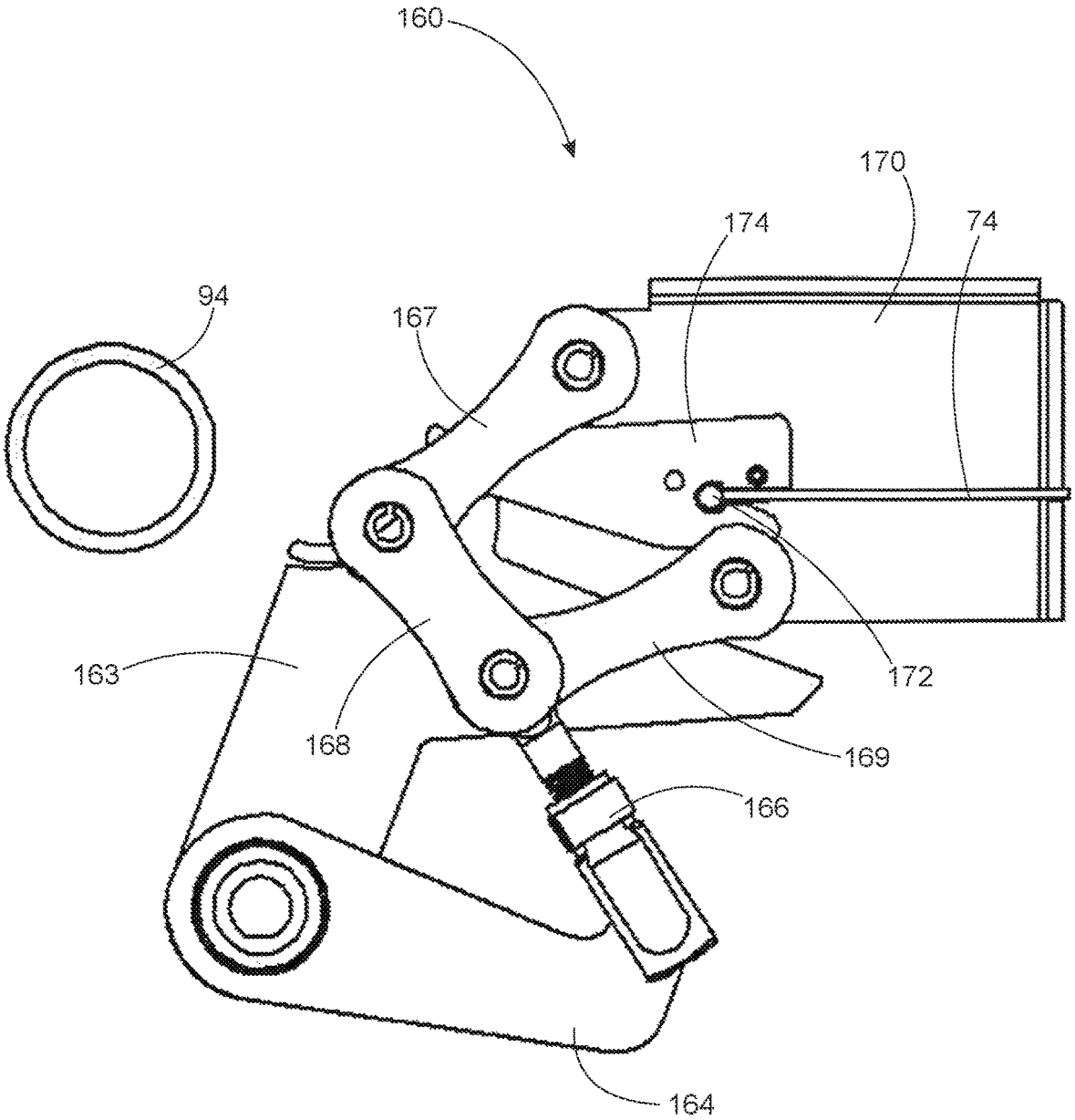
FIG. 3F is side view of a brake handle mechanism of a brake system of a reel device in a brake engaged position in accordance with an embodiment.
Figure 3G:
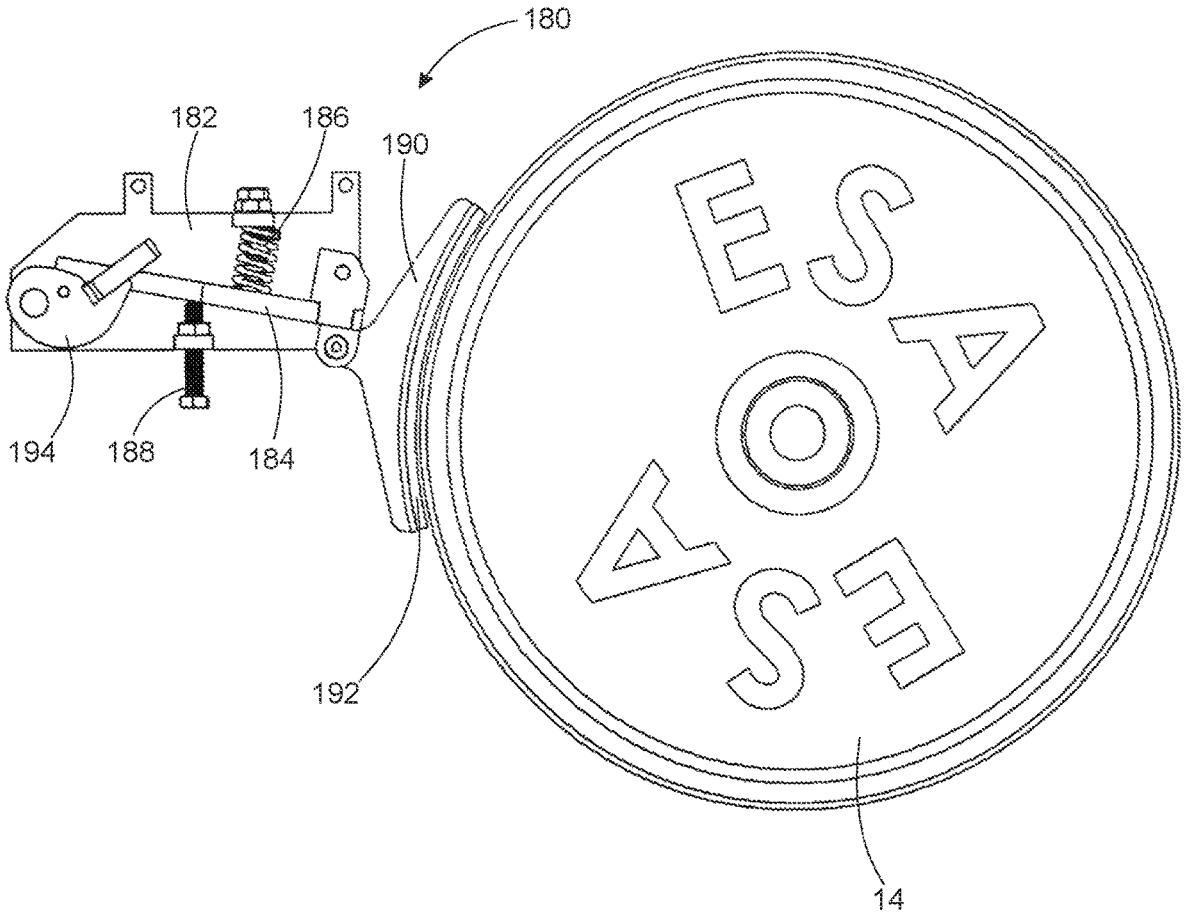
FIG. 3G is side view of a brake pad mechanism of a brake system of a reel device in a brake released position in accordance with an embodiment.
Figure 3H:
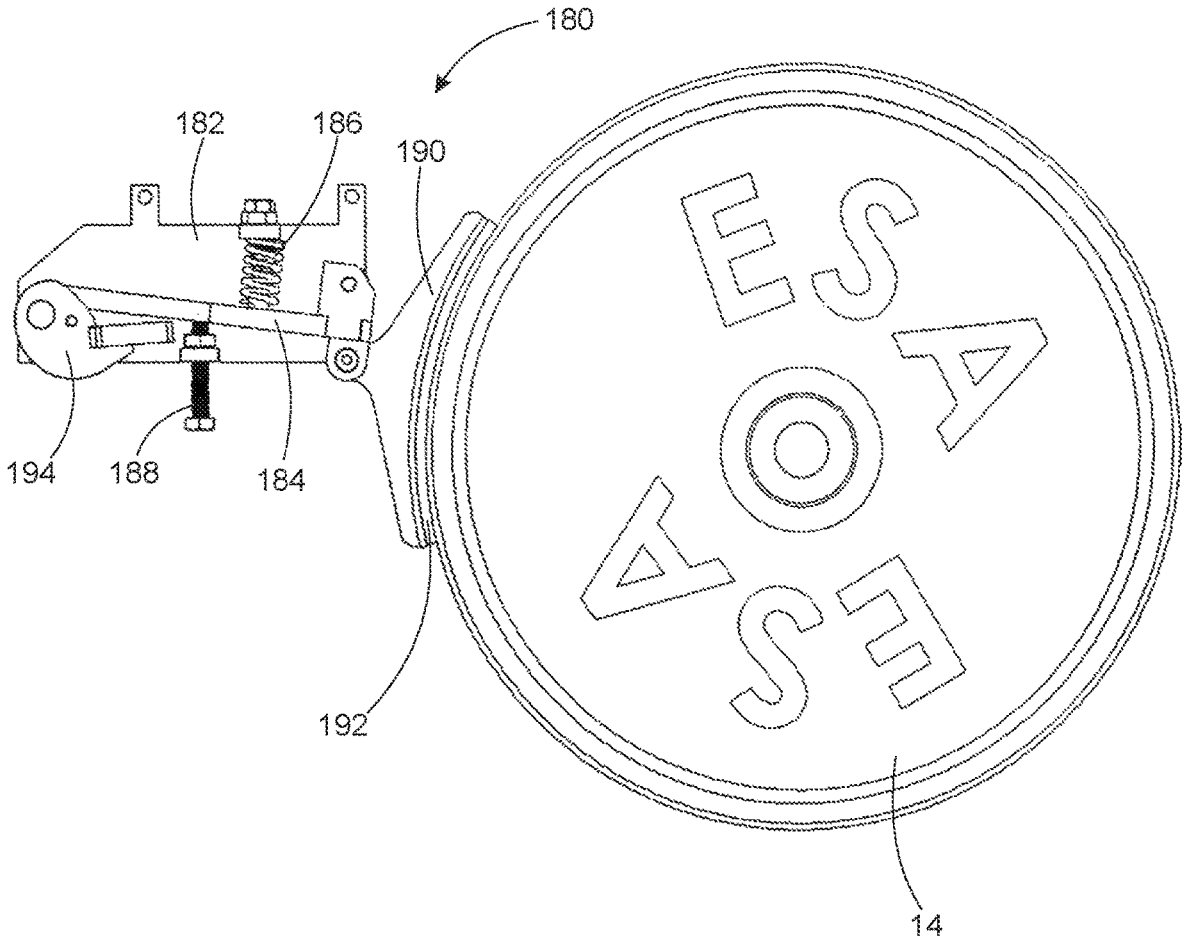
FIG. 3H is side view of a brake pad mechanism of a brake system of a reel device in a brake engaged position in accordance with an embodiment.

As shown in FIG. 1-2B, the reel mechanism 11 further includes an arm 30 rotatably coupled to the wheel housing 12 on one end of the arm 30. The reel mechanism 11 also includes an actuator 40 operably coupled between the wheel housing 12 and the arm 30, wherein the actuator 40 operates to move the arm 30 between a lowered position with the arm rotated close to the wheel housing 12 with the actuator 40 in a fully retracted position (See FIG. 2A) and a lifted position with the arm rotated away from the wheel housing 12 with the actuator 40 extended (See FIG. 2B). In the fully lifted position of the arm 30, the axle 32 is located above the wheels 14. Further, the wheels 14 and caster 16 provide support when the reel 50 is loaded on the reel device by coupling the axle 32 to the arm 30. In the lowered position of the arm 30, the axle 32 may be located away from the wheels 14 and in a position to more easily load a reel onto the axle 32 coupled between the arms 30 of the reel mechanisms 11.

Each arm 30 may be formed of two plates coupled together and each arm 30 may be coupled between the plates forming the wheel housing 12. Additionally, the actuator 40 may be coupled between the plates forming the wheel housing 12 one end of the actuator 40 and coupled between the plates forming the arm 30 on the opposing end of the actuator 40. A torque bar 39 may be coupled between the arms 30 and operates to reduce or inhibit torque on the arms 30 during operation or lifting of a reel using the hydraulic actuator 40. Further, since there are two actuators 40, one coupled between one arm 30 and one wheel housing 12, the torque bar 39 operates to time the rotation of each arm 30 from a loading position, where the reel is loaded onto the axle 32 and a transport/payoff position wherein the axle 32 is above the wheels 14. In embodiments, the arms 30 may have extended members 31, one extended member 31 coupled to each arm 30 with the torque bar 39 coupled between the extended members 31.

The two reel mechanisms 11 may be coupled together with a hydraulic system housing 118 and/or a support member 119. Additionally, the two reel mechanisms may include fork lift brackets 18 and 20 located in positions to allow a fork lift to insert its forks through the brackets 18 and 20 to lift the reel device 10. In some embodiments, a caster 22 is coupled to the hydraulic system housing 118, wherein the caster 22 may be used for support and steering when a reel 50 is coupled to the reel device 10. The reel device 10 may further include a axle 32 that is coupled between an end of the arms 30 of the two reel mechanisms 11. The axle 32 may be coupled to the arm 30 by use of brackets 34. The axle 32 operates to extend through an axle sleeve 52 of a reel 50 (See FIG. 7F). The axle 32 may be removably coupled to the arm 30 with a bracket 34.

In embodiments, the height of second caster 22 may adjust for more or less stability of the reel device 10. For example, second caster 22 may be operably coupled to a mounting bracket 24 with a threaded aperture therethrough, having an adjustment handle 26 threaded therethrough that engages second caster 22, such that a user may adjust the height of second caster 22 by rotating the adjustment handle 26. When the second caster 22 is adjusted upward, this allows the reel device 10 to teeter on wheels 14, thus facilitating maneuverability of the reel device over uneven surfaces. For more stability, second caster 22 may be adjusted downward such that it and wheels 14 of the reel device 10 are in contact with the floor. Although, in embodiments, the height of second caster 22 may be adjusted by rotating an adjustment handle 26 that operably engages second caster 22, as described, this is not intended to be limiting. The height of second caster 22 may be adjustable, in some embodiments, by any other means known by a person of skill in the art.

Referring to FIGS. 3A-3H, depicted are various views of the brake system 60. The brake system 60 may include a brake handle mechanism 160, a brake pad mechanism 180 and a brake defeat 62. The brake handle mechanism 160 is operably coupled to the brake pad system by a brake cable 74.

The brake handle mechanism 160 includes a brake handle 162 rotatable away from and adjacent the handle member 94 of the reel device 10. The brake handle 162 may include a portion sized and shaped to correspond to the handle member 94 of the reel device 10. The brake handle mechanism 160 further includes a mounting bracket 170 with a first and third mechanism arm 167 and 169 rotatably coupled to the bracket 170 and a second mechanism arm 168 rotatably coupled between ends of the first and third mechanism arms 167 and 169, such that the mechanism arms 167, 168 and 169 rotate and the bracket 170 is held in a fixed position to form a four-bar linkage/mechanism. An activation arm 164 is coupled to the brake handle 162, such that rotation of the brake handle 162 rotates the activation arm 164. And adjustable linkage 166 is coupled between the activation arm 164 and the joint between the second mechanism arm 168 and the third mechanism arm 169. The rotation of the activation arm 164 activates rotation of the mechanism arms 167, 168 and 169, and are arranged to diminish the grip force required as mechanism arms 168 and 169 become more straight to each other and brake is maintained for moving the device. The mechanism arms 167, 168 and 169 operate to engage lever arm 174 and rotate lever arm 174 in response to rotation of the mechanism arms 167, 168 and 169. The lever arm 174 is rotatably coupled to the bracket 170. Brake cable 74 is coupled to lever arm 174, such as at point 172, wherein the rotation of the brake handle 162 toward the handle member 94 of the reel device 10 operates to pull the brake cable 74 and release the brake system 60 allowing wheels 14 to roll. The brake system 60 is biased to an engaged position, such that the release of the brake handle 162 results in the brake handle 162 automatically rotating away from the handle member 94 of the reel device 10 such that the brake system is automatically moved back to the engaged position.

The brake pad mechanism 180 includes a bracket 182 that is coupled to the wheel housing 12, a plate 184 rotatably coupled to the bracket 182, a biasing member 186 coupled between a top end of the bracket 182 and a top surface of the plate 184, and an adjustable stop 188, wherein the biasing member 186, such as a spring, biases the plate 184 to rotate toward the adjustable stop 188. The plate 184 is coupled to a brake pad mount 190 to which a brake pad 192 is coupled. The brake mechanism may further include a cam 194 rotatably coupled to the bracket 182, wherein the cam 194 is coupled to an end of the brake cable 74 opposite to the end coupled to the lever arm 174 of the brake handle mechanism 160. When the brake cable 74 is pulled in response to the brake handle 162 being pulled toward the handle member 94 of the reel device 10, the cam 194 is rotated and engages the plate 184. The cam 192 engages the plate 184 with enough force to overcome the force applied by the biasing member 186 to the plate 182 to rotate the plate 184 toward a top end of the bracket 182. The rotation of the plate 184 toward the top end of the bracket 182 rotates the brake pad mount 190 and brake pad 194 away from the wheel 14, placing the brake pad 194 and therefore the brake system 60 in a released position. The release of the brake handle 162 releases the force being applied to the cam 194 by the brake cable 74, wherein the force of the biasing member 186 rotates the plate 184 toward the stop 188 and the brake pad mount 190 and the brake pad 192 toward and in contact with the wheel 14 to place the brake pad 192 and the brake system 60 in the engaged position. In the engaged position, the brake pad 192 inhibits rotation of the wheel 14 and thereby inhibits rolling or movement of the reel device 10.

In embodiments, there may be a desire to keep the brake handle 162 in the released position or rotated toward the handle member 94 of the reel device 10 and to do so safely. The brake defeat 62 may be rotatably coupled to a bracket and coupled adjacent the brake handle 162. The brake defeat may include an engagement protrusion 64 extend from one end and a release cable aperture 66 extending through an opposing end from the engagement protrusion. In operation, the brake handle 162 may be pulled toward the handle member 94 of the reel device 10 in order to release the brake system 60. The brake defeat 62 may be rotated to an engaged position with the engagement protrusion 64 engaging a brake handle protrusion 163 {number is not noted in figures with a leader line.} extending from a support arm of the handle 162, wherein the brake engagement protrusion 64 maintains the brake handle 162 in the brake release position adjacent the handle member 94 when the brake handle 162 is released by the operator. A release cable (which may be a cable, tether, strap or the like) may be coupled on one end to the release cable aperture 66 and coupled on the opposing end to the operator. If the reel device 10 moves a distance away from the operator greater than the length of the release cable, the release cable will apply a force from the weight of the operator to the brake defeat 62 to rotate the brake defeat 62 and disengage the engagement protrusion 64 from brake handle protrusion 163 allowing the brake handle 162 and the brake system 60 to automatically move to the brake engaged position.

In embodiments, the reel device 10 may further comprise a handle assembly 90 comprising two handle arms 92, each handle arm 92 being coupled to a wheel housing 12, and the handle arms 92 being coupled together by a stiffening handle member 94. The bracket 170 of the brake handle mechanism 160 may be coupled to an upper portion of the handle arm 92 and the brake cable 74 may extend within the handle arm 92 to the brake pad mechanism 180. The handle assembly 90 operates to provide control of the reel device 10 allowing an operator to push, pull, steer and otherwise control the movement of the reel device 10 with or without a reel 50 coupled to the reel device 10.

In embodiments, as shown in FIGS. 6A-6D, bracket 34 may comprise a clasp 36 hingedly coupled to the arm 30, such that the clasp 36 extends outward from the arm 30 in an open position and a user may rotate the clasp upward and inward to the arm 30 to close the clasp to a closed position. The clasp 36 may be configured with a spring-loaded latch 38 for locking the clasp 36 into the closed position. The clasp 36 may be unlocked by a user by grasping and lifting the spring-loaded latch 38 to open the clasp 36. A plurality of linear bearings 42 may be coupled between the plates of the arm 30 for bearing the load of the axle 32. The clasp 36 may be formed of two plates 44 coupled together and further comprising a plurality of linear bearings 42 coupled between the plates 44 such that the linear bearings 42 between the plates 44 of the clasp 36, together with the linear bearings 42 between the plates of the arm 30 engage the axle 32 while the clasp 36 is in the closed position, thereby maintaining the axle 32 in position within the bracket 34 while allowing the axle 32 to rotate freely in response to a user rotating a reel 50 supported on the axle 32. This description of bracket 34 is not intended to be limiting. Bracket 34 may be configured in any manner known by a person of skill in the art suitable for securing an axle while allowing rotation of the axle.

The bracket 34 may include a drag system 220. The drag system 220 operates to control the rate at which the reel freely rotates during payoff. In some instances, the reel moves too freely causing the reel to continue to rotate and payoff cable even when such cable is no longer being pulled. The drag system 220 includes an actuator 222 with a spring 224 coupled to the actuator and a drag member 226 rotatable coupled to a drag bracket 221, the drag bracket 221 coupled to the bracket 34. In operation the actuator 222 may be manually rotatable actuator wherein rotation in one direction moves the spring 224 away from the drag member 226 to apply no drag to the axle 32 and rotation in the other direction moves the spring 224 to contact the drag member 224 and move the drag member 226 in contact and engagement with the axle 32 to apply drag to the rotation of the axle.

The actuators 40 may be hydraulic actuators and/or electromechanical actuators, or any other actuators known by a person of skill in the art now or in the future. For example, some embodiments may comprise electromechanical actuators having an electrically driven hydraulic actuator pump and cylinders and being powered by a rechargeable battery coupled to the reel device. The actuators 40 may be coupled to a controller (not shown) wherein the controller operates the actuators 40 simultaneously to extend and retract to move the arms 30 to the lifted position and the lowered position respectively. The reel device 10 may be in a fully lifted position or any position between a fully lifted position and fully lowered position depending on the needs of the operator. For example, without limitation, the reel device 10 may be in the lifted position or partially lifted position for transport, wherein the lifted position lifts a reel 50 off of the ground surface, in the fully lowered position for loading the reel 50 onto the reel device, or in the fully lifted position for payoff/take-up. The reel device may store the reel 50 on it in either the lifted or the lowered positions. In at least this way, the reel device 10 may be used to store, load, transport and payoff/take-up.

In operation of embodiments, the reel device 10 may receive and retain a reel 50. For example, the axle 32 may be extended through the axle sleeve 52 of the reel 50 (See FIG. 7F). After inserting the axle 32 through the axle sleeve 52, the axle 32 may be coupled between the arms 30 with bracket 34. Once the reel 50 is mounted to the reel device 10, the wheels 14 may be utilized to transport the reel 50. The wheels 14 may be centrally located on the wheel housing 12 allowing an operator to balance the reel 50 easily on the wheels 14 in order to maneuver the reel 50 through a building or other location. The casters 16 and 22 may be used to support the reel device 10 during loading of the reel 50 and to assist in steering and stabilizing of the reel device 10 during transport.

In operation of embodiments, an operator may push or pull the reel device 10 by moving the brake handle 162 toward the handle member 94 and pushing or pulling the handle member 94. The operator may thereby push the reel device 10 toward a reel 50, the reel 50 having a axle 32 inserted therethrough, to mount the axle 32 into the brackets 34. The operator may secure the axle 32 into the brackets 34 by closing the clasps 36, such that the clasps 36 are locked by the latches 38. The operator may then raise the reel 50 off the ground by extending the actuators 40 with the actuator controller 250 to raise the arms 30. The operator may then push or pull the reel device 10 by pushing or pulling the handle member 94 with the brake handle 162 pulled toward the handle member 94 to maneuver the reel 50. With the reel 50 lifted off the ground, the reel 50 is free to rotate for payoff or take-up. For payoff, the reel 50 may be used as contractors or operators typically pull cable from the reel.

However, FIGS. 7A-7I depict a take-up system wherein an external drive is a motor 230 to rotate the axle 32, wherein rotation of the axle 32 rotates the reel 50 coupled to the axle 32 in order to take-up cable to the reel 50. The take-up system may comprise a motor 230, a controller 250, a motor cage 251, a motor/controller mount 252 a foot pedal 262, an axle adapter 270, a gear box 255, and a safety switch 256.

The motor cage 251 may include gear box mounting brackets 253 and guide tubes 258. The motor cage 251 is configured to couple the motor 230 and the gear box 255 to the motor cage 251, wherein the motor 230 is coupled to the gear box 255. The motor/controller mount 252 includes a controller mount 260, a mount support 261 and guide rods 259. The guide rods 259 are configured to slide within guide tubes 258 of the motor cage 251 and may be coupled within the guide tubes 258 in order to couple the motor/controller mount 252 to the motor cage 251. The controller 250 may be coupled to the motor 230 in order to control operation of the motor 230. The foot pedal 262 may be coupled to the controller 250 such that depressing the pedal 262 sends a signal to the controller 250 to operate the motor 230, such that the motor 230 operates to turn the gear box 255 and then the reel 250 for take-up/payoff functionality. Releasing the foot pedal 262 results in the stopping of the motor 230 and stopping of rotating the reel 50.

The take-up system includes an axle adapter 270 that includes a first sleeve 272 having a first size aperture and a second sleeve 273 having a second size aperture, wherein the first size aperture is larger than the second size aperture. The sleeves 272 and 273 are coupled together with an elongate C-channel 274. A carriage 276 is slidingly coupled to the C-channel 274, wherein the carriage 276 is configured to be releasably secured in fixed locations along the length of the c-channel 274. A mating rod 278 is coupled to the carriage 276. The mating rod 278 is configured to insert within a hole 51 in the reel 50 (see FIG. 7F). When the adapter 270 turns, the mating rod 278 contacts the reel 50 through the hole 51, thus allowing the reel 50 to turn with the adapter 270. The carriage 276 is adjustable because the adapter hole 51 in the reel 50 is not always in the same location.

The take-up system also includes a safety switch 256 that operates to ensure that take-up functionality only occurs when the reel 50 is in the proper position. The safety switch 256 may be a contact switch that may include a fixed safety sensor 257 and a moveable safety sensor 258 that operate to prevent the motor 230 from turning when the cylinders 40 are retracted, and only operate when the cylinders 40 are extended and the arms 30 are in an upright position. When the arm 30 is in a fully upright position, the fixed sensor 257 and the moveable sensor 258 of the contact switch 256 are in contact, or in close proximity, with each other, which connects power to the motor 230. When the arm 30 is not in a fully upright position, the fixed sensor 257 and the moveable sensor 258 of the contact switch 256 separate, which disconnects power to the motor 230. This provides safe operation of the take-up system.

Figure 8:
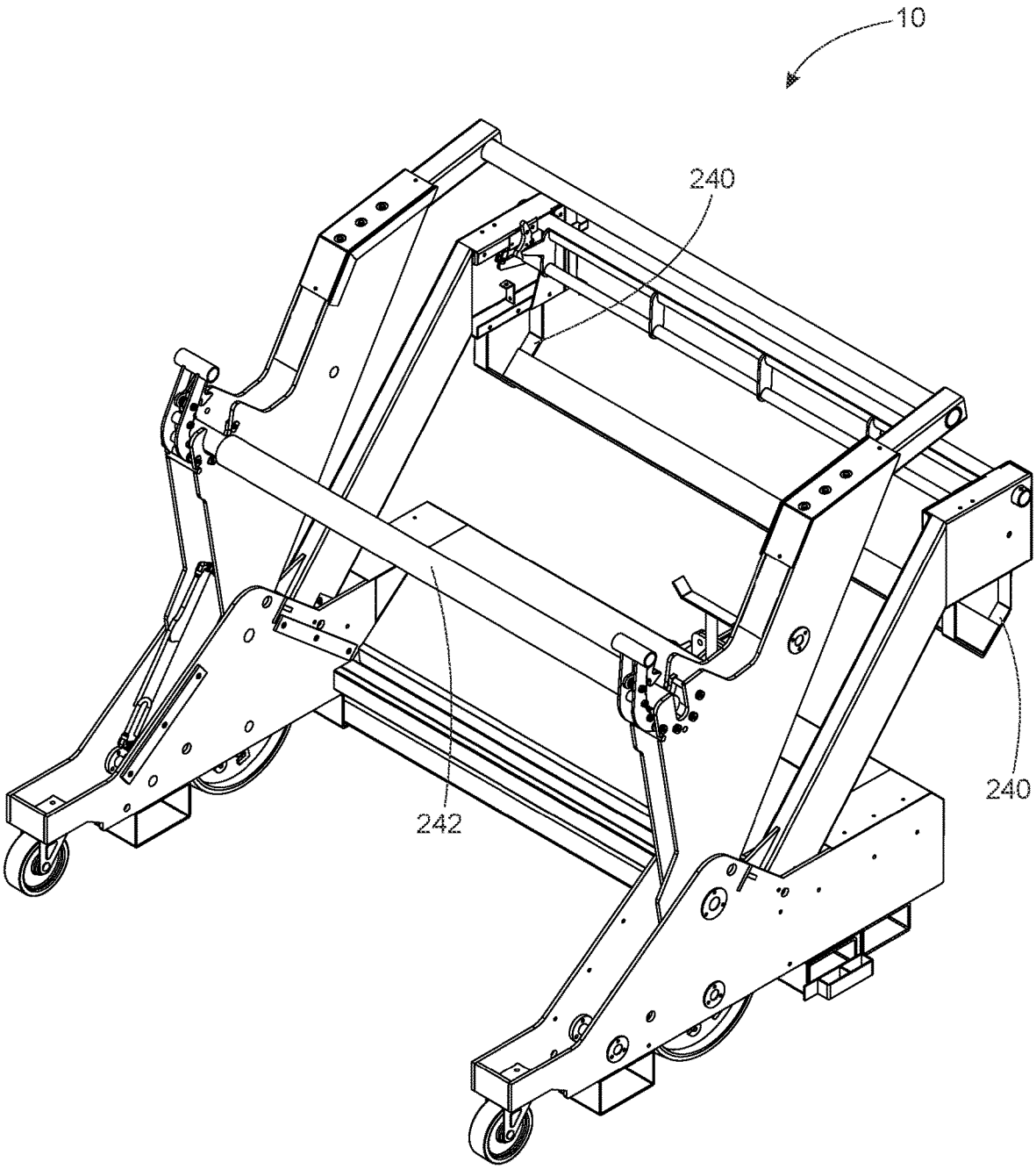
FIG. 8 is a perspective view of a reel device with an axle holder in accordance with an embodiment.

In some embodiments, as shown in FIG. 8, the reel device 10 may be a larger reel device 10 that is utilized to transport a reel that is smaller than the width of the axle 32. In such embodiments a larger axle 242 may be coupled over the axle 32 to provide additional support to the axle 32 to prevent bending of the axle 32. When the larger axle 242 is not in use, axle holders 240 may be coupled below an upper portion of the handle arms 92, wherein the larger axle 242 may be placed onto the axle holder 240 and further may be strapped or secured using a securing strap or device (not shown).

Figure 4A:
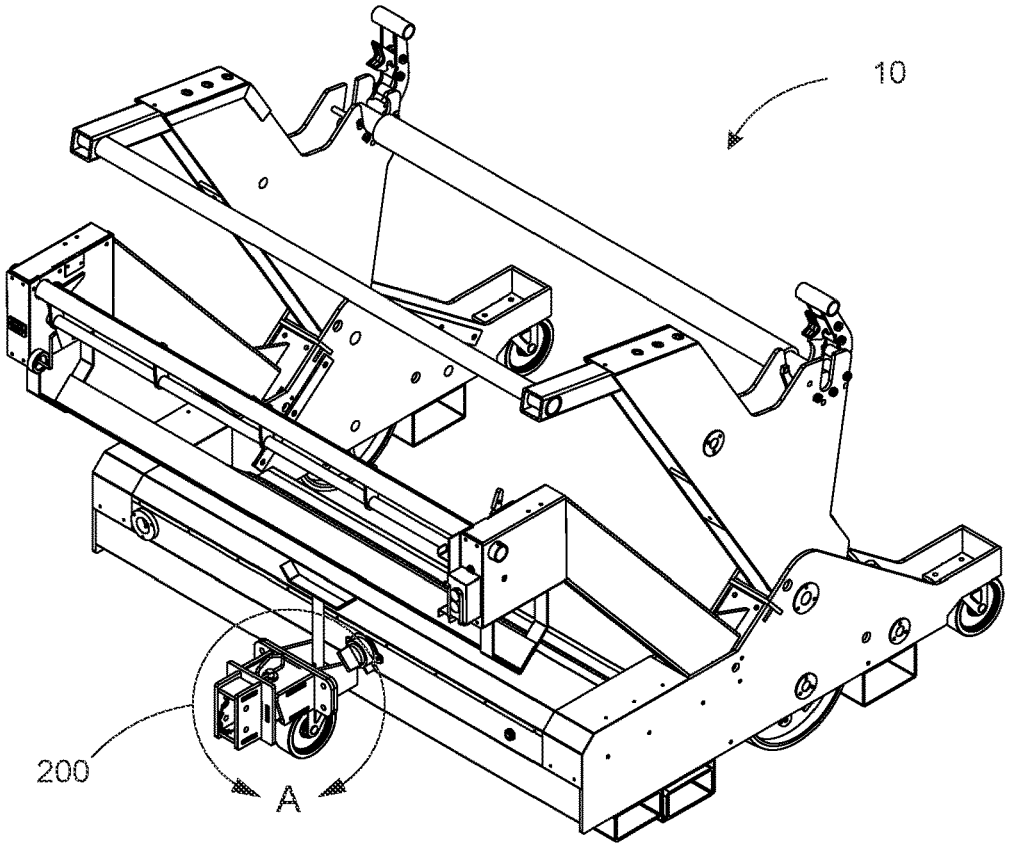
FIG. 4A is a perspective view of a reel device with a pulling unit hitch/coupler in accordance with an embodiment.
Figure 4B:
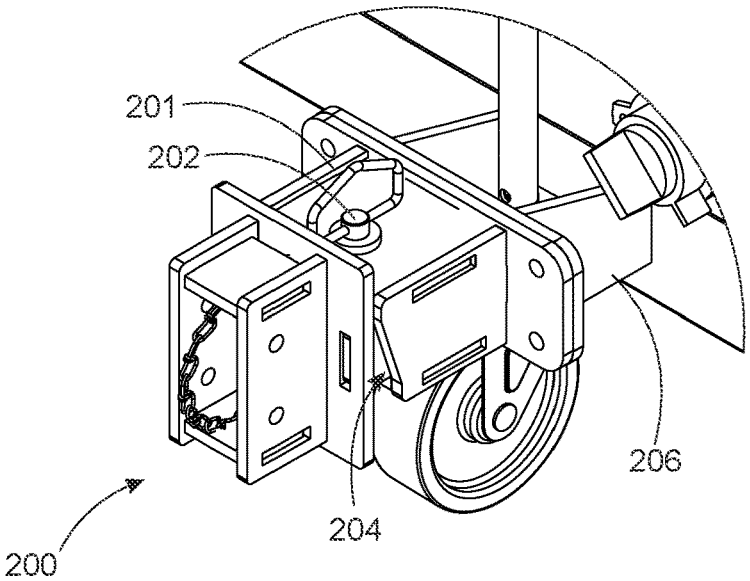
FIG. 4B is a close-up perspective view of a reel device with a pulling unit hitch/coupler in accordance with an embodiment.

With the reel 50 lifted, a powered transport may be utilized to move the reel 50. In these embodiments, as shown in FIGS. 4A-4B, a transport coupling system 200 may be utilized. The transport coupling system 200 may include a transport coupling member 201 having a recess 204 to receive a protrusion from a transport (not shown) and a pin 202 to couple the protrusion from the transport to the coupling member 201. The coupling member 201 may be coupled to a transport bracket 206 that is coupled to the reel device 10, such a base of the hydraulic system housing 118. The transport may be operated to move the reel device 10. In these embodiments where a powered transport is utilized, the brake defeat 62 is utilized to release the brake system 60 and allow the powered transport to move the reel device 10.

Embodiments of a reel device 10, as described herein, are able to be maneuvered and turned by a user with a zero turning radius. Although embodiments of a reel device described herein comprise two wheels 14, two first casters 16, and a second caster 22, this is not intended to be limiting. It is understood that embodiments may comprise any combination of a plurality of wheels and/or casters suitable for supporting and maneuvering a reel device.

Figure 5A:
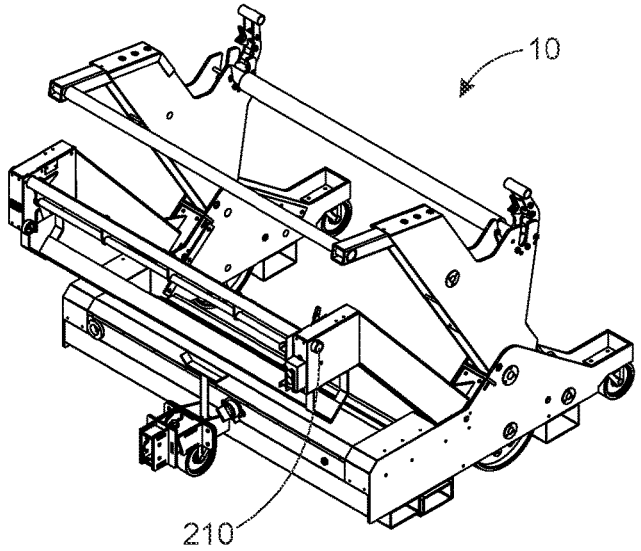
FIG. 5A is a perspective view of a reel device with a holder for a bar in accordance with an embodiment.
Figure 5B:
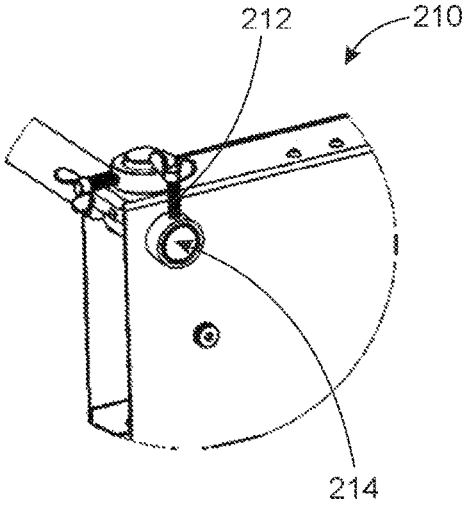
FIG. 5B is a close-up perspective view of a reel device with a holder for a bar in accordance with an embodiment.
Figure 5C:
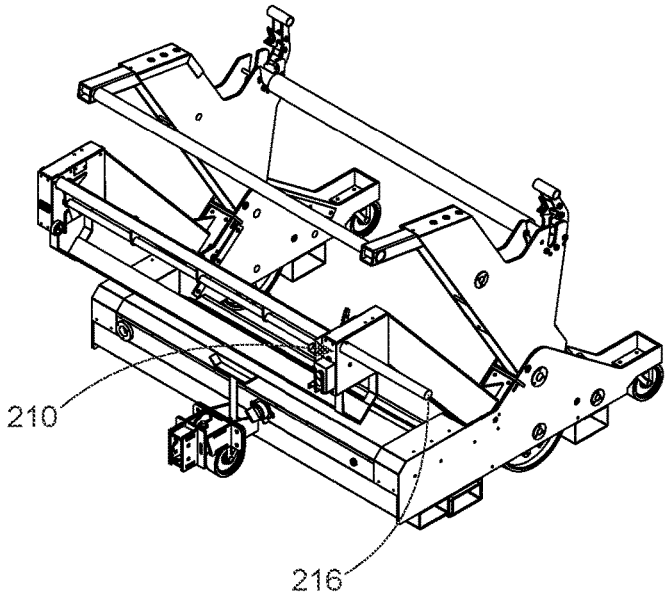
FIG. 5C is a perspective view of a reel device with a holder holding a bar in accordance with an embodiment.
Figure 6A:
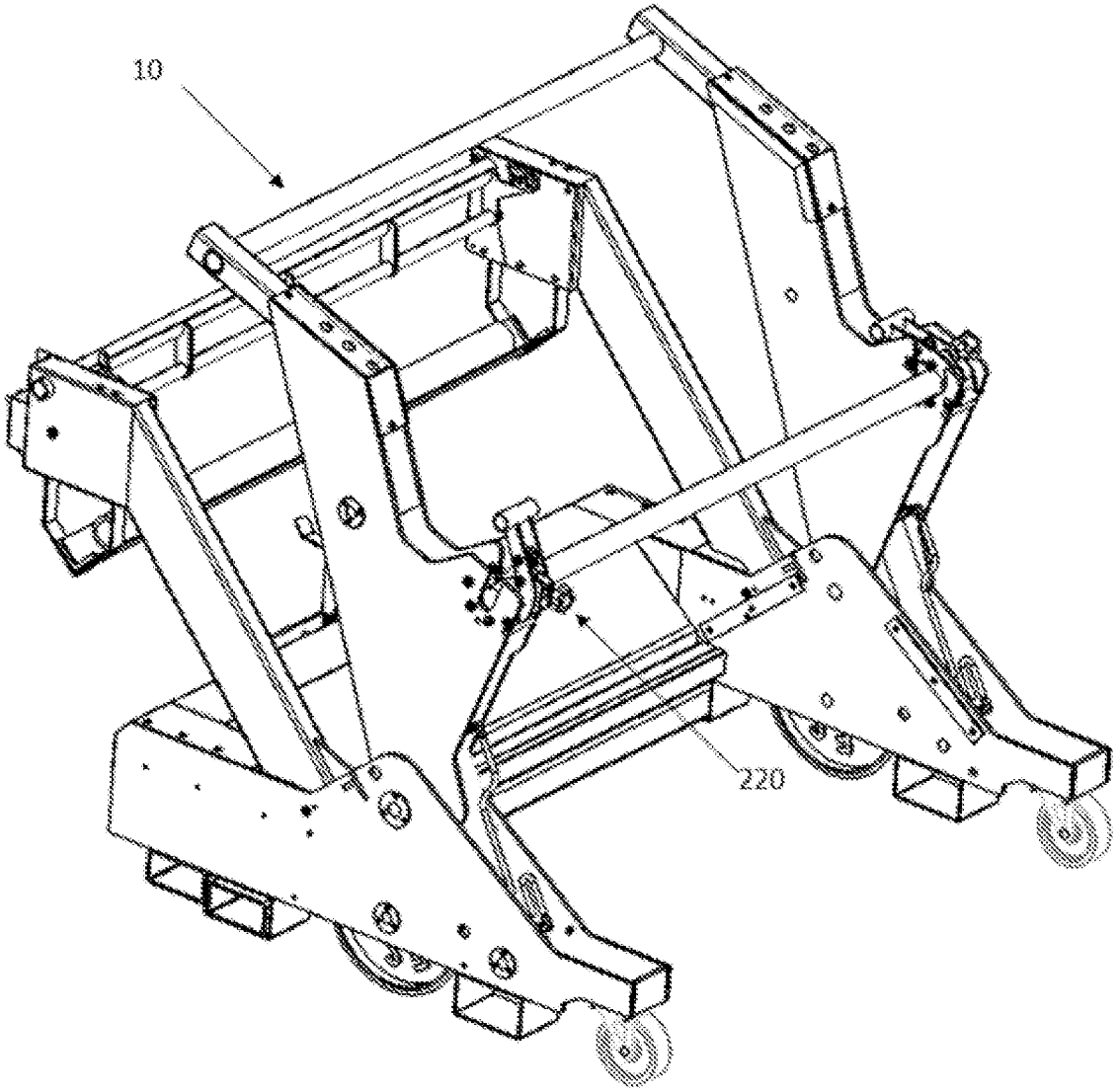
FIG. 6A is a perspective view of a reel device with a bracket having a drag system in accordance with an embodiment.
Figure 6B:
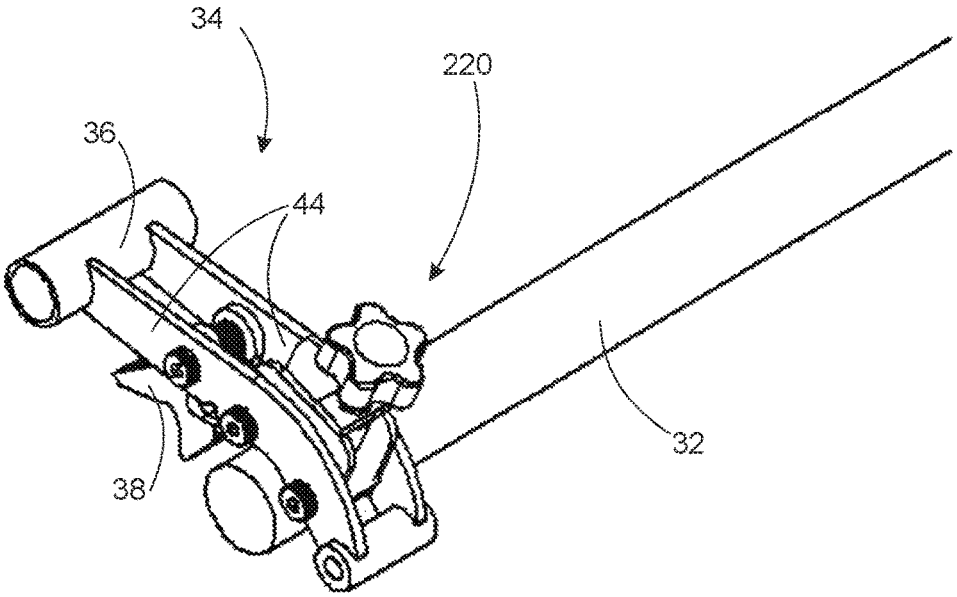
FIG. 6B is a close-up perspective view of a reel device with a bracket having a drag system in accordance with an embodiment.
Figure 6C:
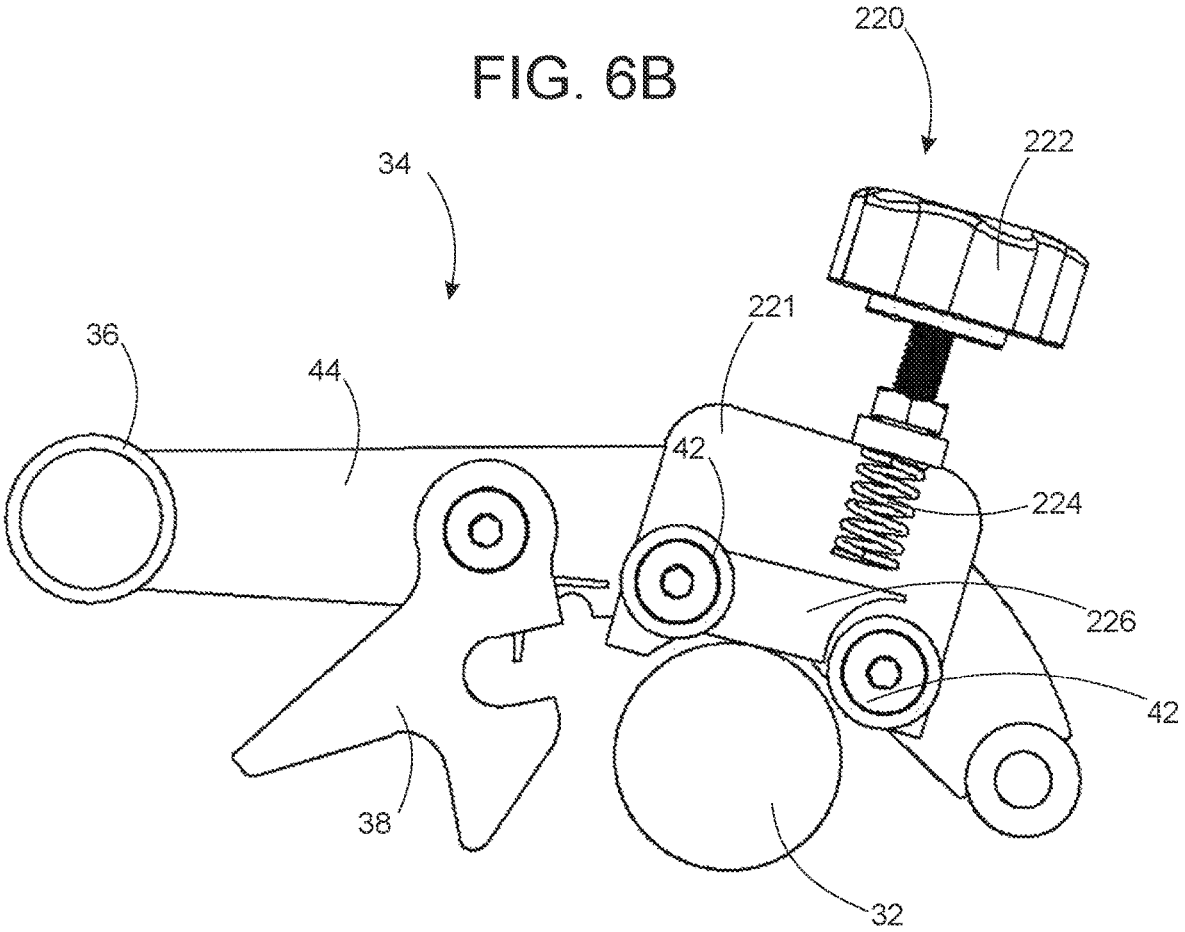
FIG. 6C is a side view of bracket with a drag system of a reel device not engaged in accordance with an embodiment.
Figure 6D:
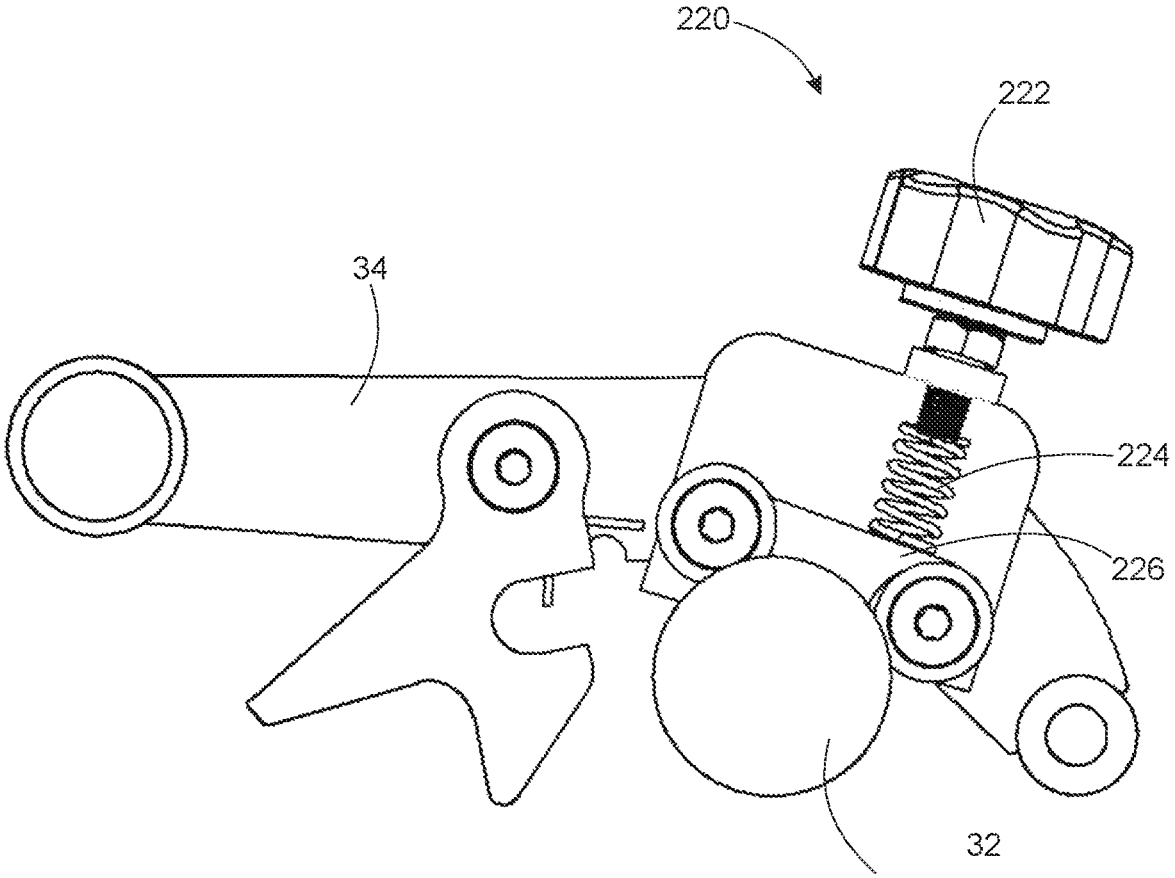
FIG. 6D is a side view of bracket with a drag system of a reel device engaged in accordance with an embodiment.
Figure 7A:
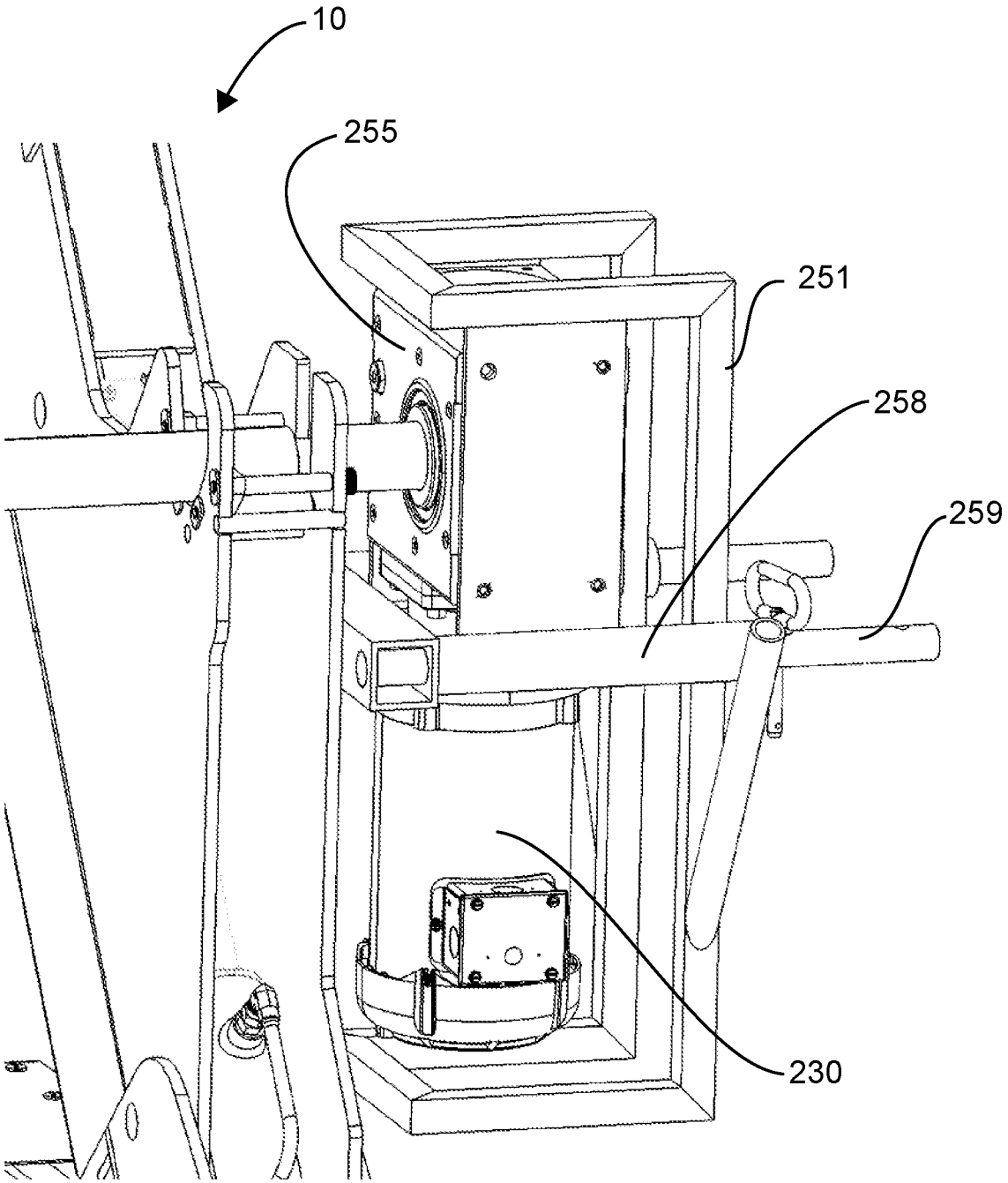
FIG. 7A is a perspective view of a reel device with a take-up system coupled thereto in accordance with an embodiment.
Figure 7B:
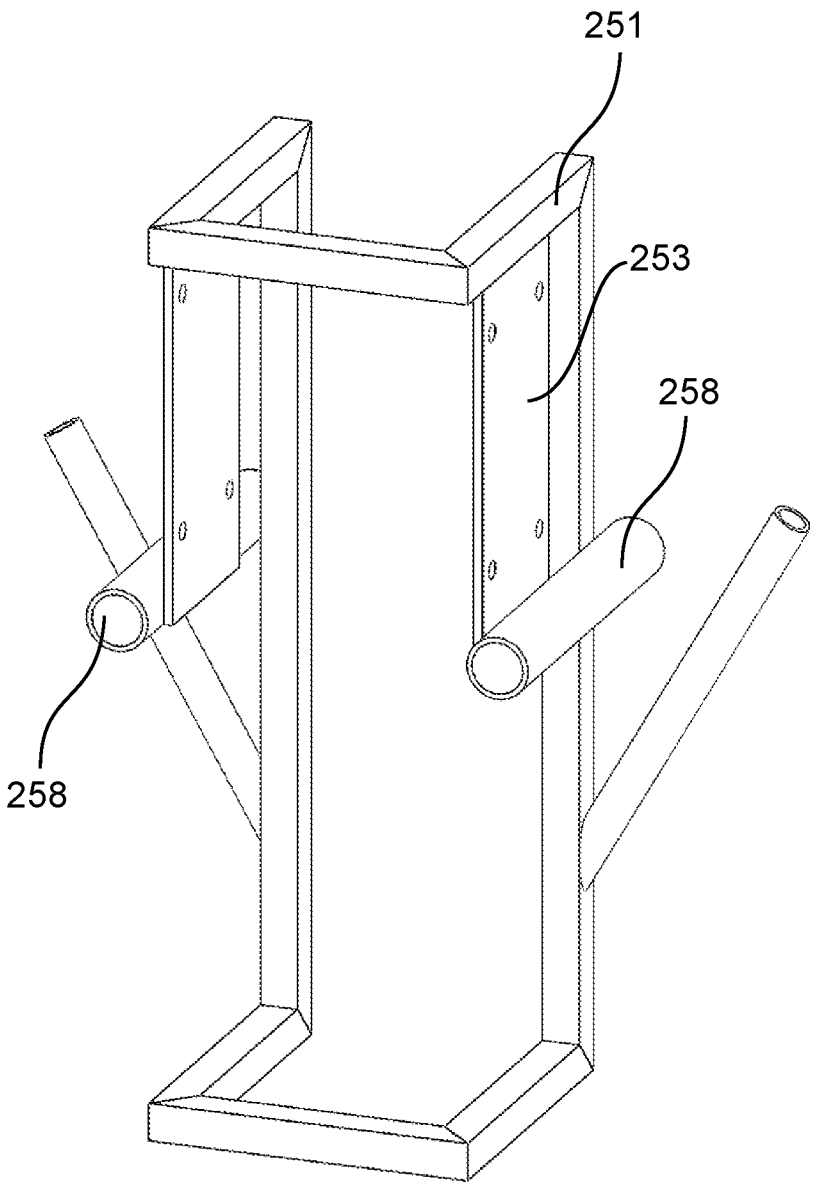
FIG. 7B is a perspective view of a motor cage of a take-up system coupled thereto in accordance with an embodiment.
Figure 7C:
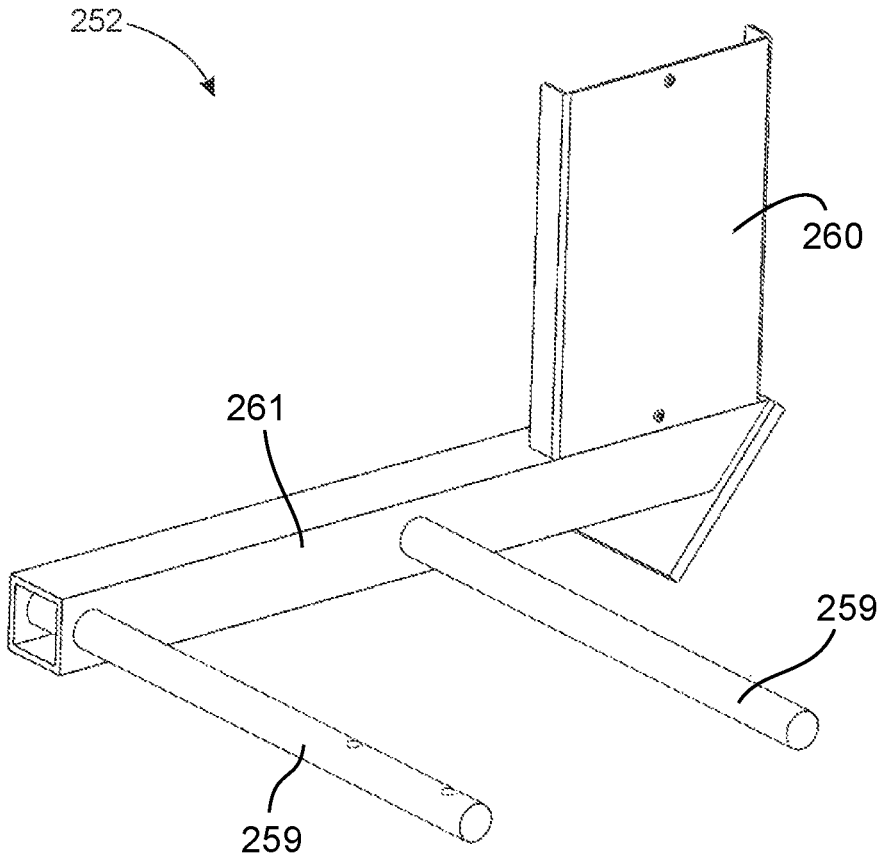
FIG. 7C is a perspective view of a motor/controller mount of a take-up system coupled thereto in accordance with an embodiment.
Figure 7D:
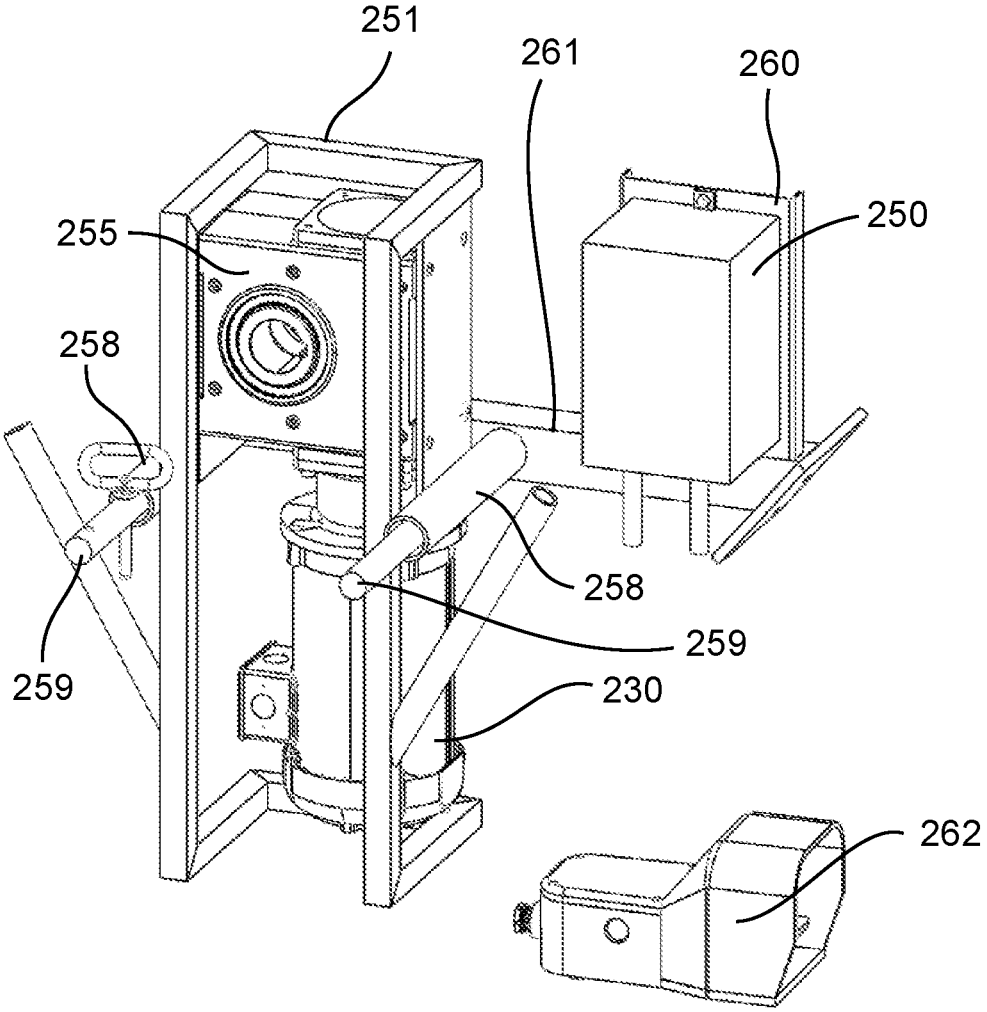
FIG. 7D is a perspective view of a take-up system coupled thereto in accordance with an embodiment.
Figure 7E:
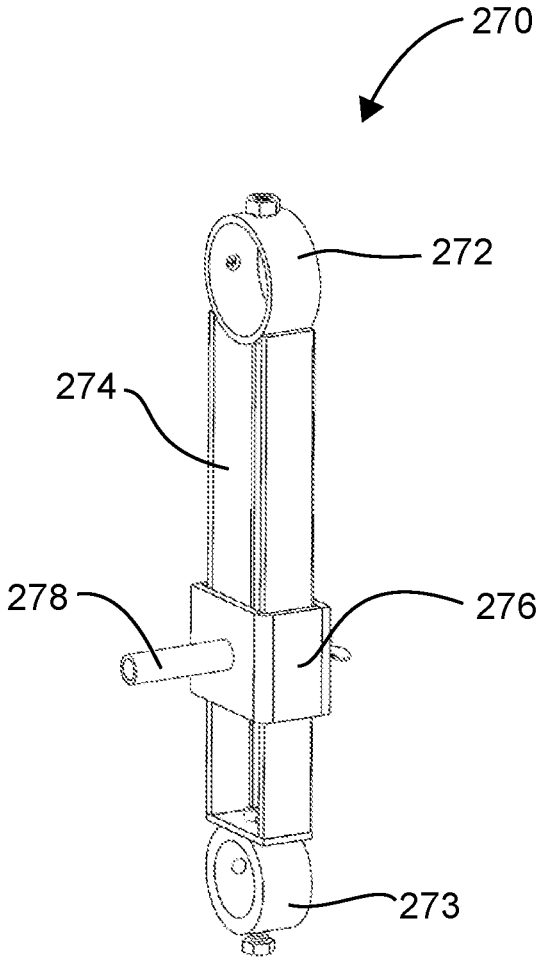
FIG. 7E is a perspective view of an axle adapter of a take-up system coupled thereto in accordance with an embodiment.
Figure 7F:
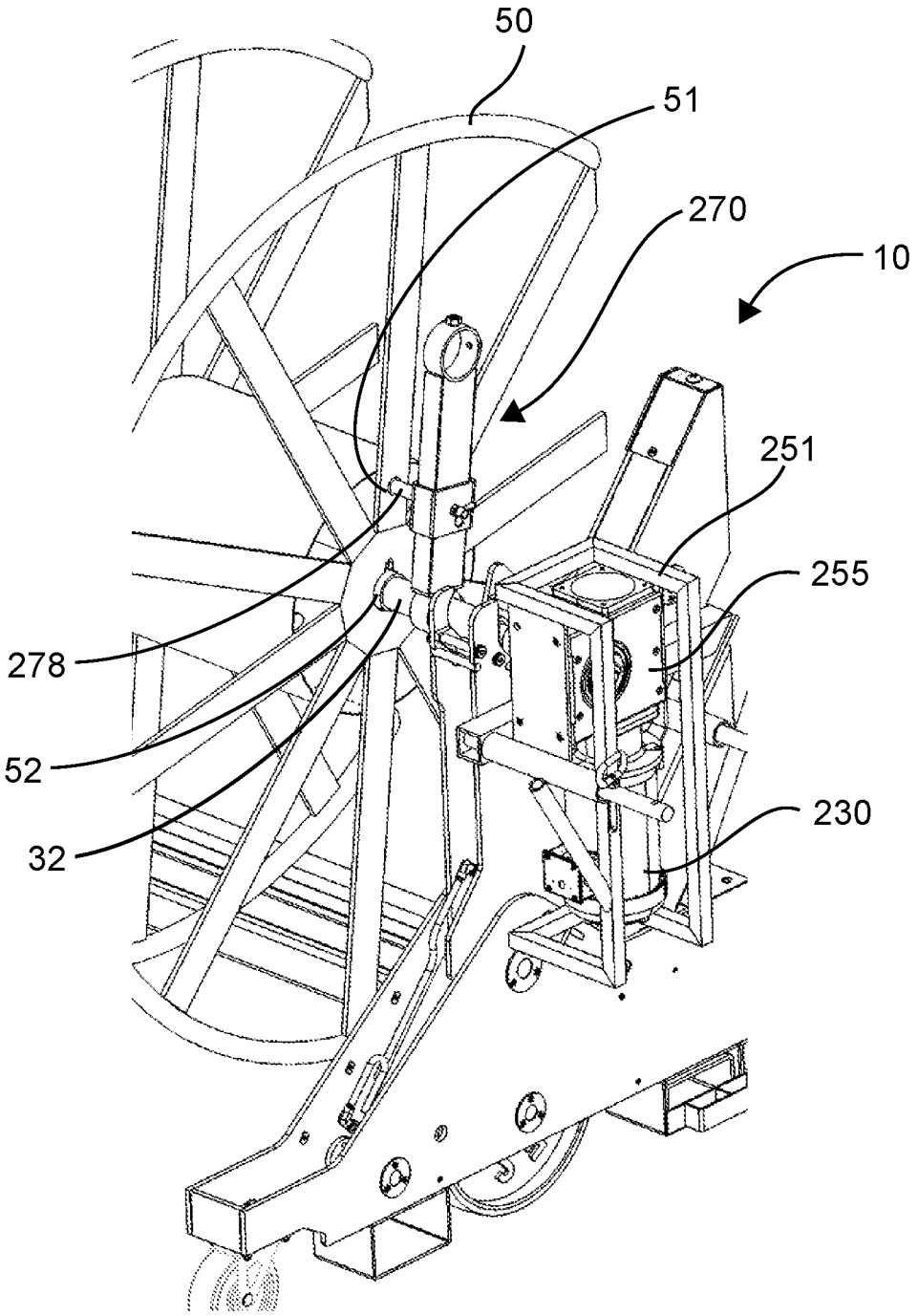
FIG. 7F is a perspective view of a reel device with a take-up system coupled thereto in accordance with an embodiment.
Figure 7G:
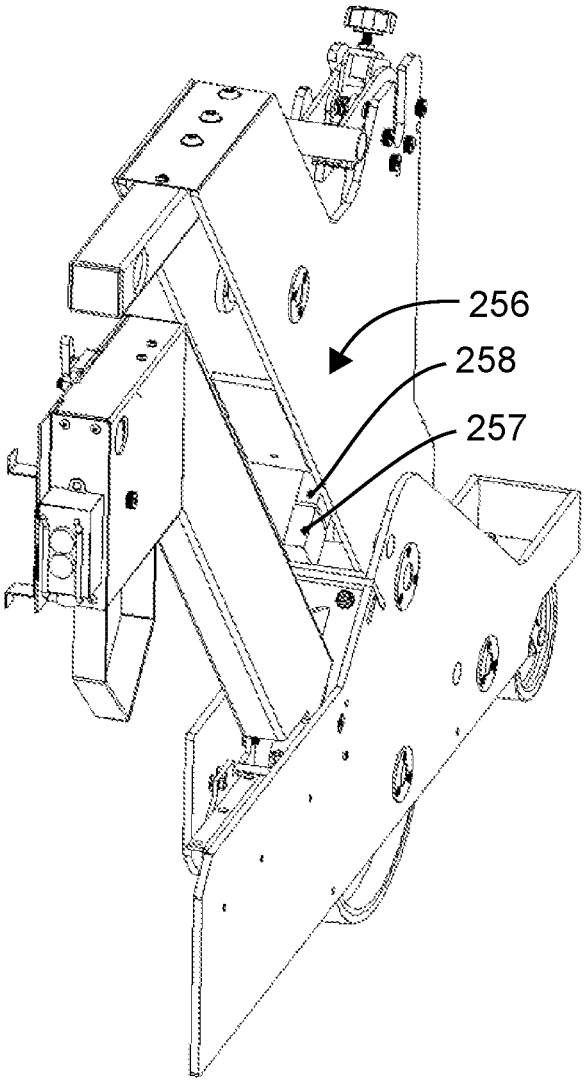
FIG. 7G is a perspective view of a reel device with a safety switch of a take-up system coupled thereto in accordance with an embodiment.
Figure 7H:
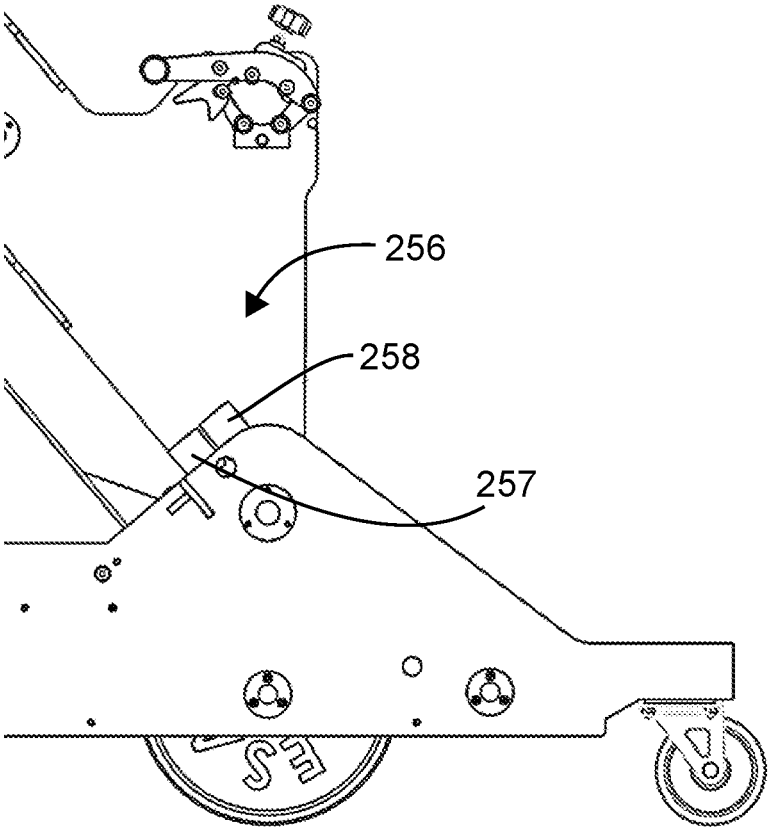
FIG. 7H is a side view of a reel device with a safety switch of a take-up system coupled thereto in accordance with an embodiment.
Figure 7I:
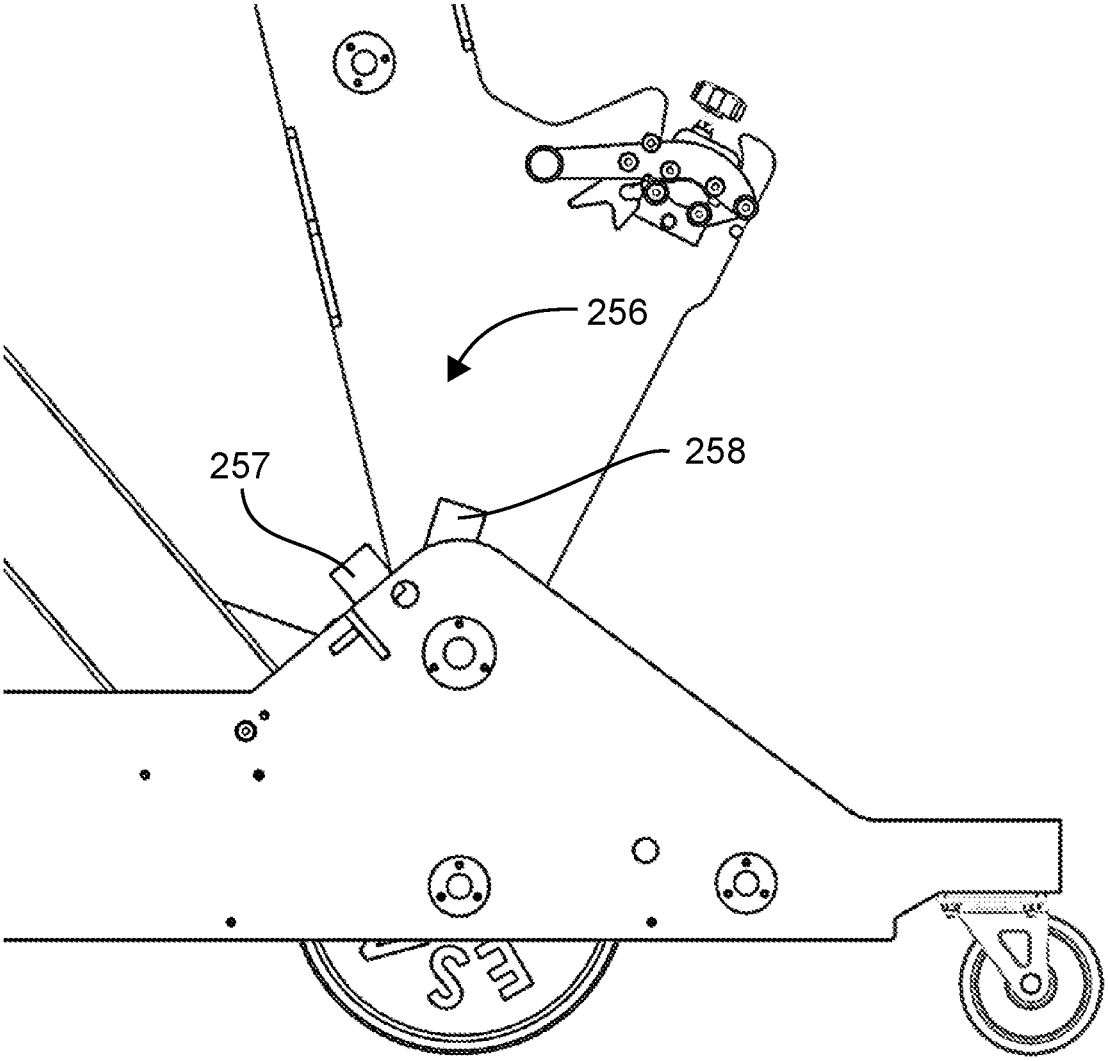
FIG. 7I is a side view of a reel device with a safety switch of a take-up system coupled thereto in accordance with an embodiment.

In some embodiments, there may be a need to mount an additional smaller reel to the reel transport 10, such as a ground wire reel. As shown in FIGS. 5A-5C, a bar holder 210 may be a part of the reel device 10. The bar holder 210 comprises an engagement member 212 and an aperture 214 extending through handle member 94. A bar 216 may be inserted within the aperture 214 of the handle member 94. The engagement member 212 may then be used to engage and secure the bar 216 within the aperture 214. A smaller reel, such as a ground wire reel, may then be coupled to the bar and used for payoff of the small reel.

An embodiment may also include a method of using a reel device. The method may include the steps of extending an axle 32 of the reel device 10 through an axle sleeve 52 of the reel 50; coupling the axle 32 between arms 30 of reel mechanisms of the reel device 10; moving the arms 30 from a lowered position to a lifted position, wherein the partially lifted position lifts the reel 50 off of a ground surface; transporting the reel 50 by use of wheels 14 of the reel device 10; and maintaining the arms 30 in the lifted position for reel payoff. The method may also include operating hydraulic actuators of each reel mechanism simultaneously to move the arms between the lowered and lifted positions.

Accordingly, the components defining any reel device 10 may be formed of any of many different types of materials or combinations thereof that can readily be formed into shaped objects provided that the components selected are consistent with the intended operation of a reel device 10. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any reel device 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, 3D printing, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A reel device comprising:

two reel mechanisms, each reel mechanism comprising:

a wheel housing;

a wheel coupled to a central portion of the wheel housing;

an arm coupled on an end to a central portion of the wheel housing; and an actuator operably coupled between the wheel housing and the arm, whereby extension of the actuator rotates the arm to a lifted position and retraction of the actuator rotates the arm to a lowered position;

a hydraulic system housing coupled between the two reel mechanisms, wherein the hydraulic housing retains a hydraulic system for operating the actuators;

an arm assembly coupled between the two wheel housings;

a brake system biased to a brake engaged position and moveable to a brake released position for transport of the reel device; and an axle coupled between an end of each arm of the reel mechanisms, the axle configured to receive a reel thereon.

2. The reel device of claim 1, wherein the brake system comprises a brake handle mechanism; a brake pad mechanism moveable between the brake engaged position and the brake released position; and a brake defeat.

3. The reel device of claim 2, wherein the brake handle system comprises a brake handle rotatable away from and adjacent the handle member of the reel device, wherein the brake handle is in a brake engaged position when rotated away from the handle member and in a brake release position when rotated adjacent the handle member.

4. The reel device of claim 3, the brake handle system comprises an activation arm coupled to the brake handle, such that rotation of the brake handle rotates the activation arm.

5. The reel device of claim 4, wherein rotation of the activation arm operates the brake pad mechanism to move from a brake engaged position to a brake released position.

6. The reel device of claim 5, wherein the brake defeat is rotatably coupled adjacent the brake handle.

7. The reel device of claim 6, wherein the brake defeat is rotated to an engaged position with the brake, wherein the brake defeat maintains the brake handle in the brake release position.

8. The reel device of claim 6, further comprising a release cable coupled to the brake defeat on one end and coupled on the opposing end to the operator, wherein in response to the reel device moving a distance away from the operator greater than a length of the release cable, the release cable will apply a force from a weight of the operator to the brake defeat to rotate the brake defeat and disengage from the brake handle to automatically move the brake handle to the brake engaged position.

* * * * *